US006059180A

United States Patent [19]

Collins

[11] Patent Number: 6,059,180

[45] Date of Patent: May 9, 2000

[54] REINFORCED PAPERBOARD BOX FOR STORAGE AND SHIPPING OF ELONGATED ITEMS

[76] Inventor: Daren Collins, 10217 Sage Hill Way, Escondido, Calif. 92026

[21] Appl. No.: 09/323,285

[22] Filed: Jun. 1, 1999

[51] Int. Cl.[7] ..... B65D 25/04

[52] U.S. Cl. ..... 229/120.13; 206/591; 206/740; 206/765; 229/120.18; 229/120.21

[58] Field of Search ..... 229/120.08, 120.13, 229/120.14, 120.18, 120.21; 206/591, 592, 740, 743, 744, 765

[56] References Cited

U.S. PATENT DOCUMENTS

| | | | |
|---|---|---|---|
| 1,055,651 | 3/1913 | Porter | 206/740 |
| 2,308,818 | 1/1943 | Levkoff | 229/120 |
| 2,536,990 | 1/1951 | Williamson | 229/120.13 |
| 2,847,152 | 8/1958 | Antwerpen | 206/592 |
| 2,850,224 | 9/1958 | Meinhardt et al. | 229/120.21 |
| 2,854,181 | 9/1958 | Smith | 229/120.18 |
| 3,229,889 | 1/1966 | Vrana | 229/120.14 |
| 3,441,125 | 4/1969 | Small | 206/784 |
| 3,563,449 | 2/1971 | Forbes, Jr. | 229/120.18 |
| 3,735,916 | 5/1973 | Buttery | 229/120.13 |
| 3,869,062 | 3/1975 | Jaeschke et al. | 229/120.18 |
| 4,034,908 | 7/1977 | Forbes, Jr. et al. | 229/120.18 |
| 4,177,918 | 12/1979 | Lane | 206/418 |
| 4,342,417 | 8/1982 | Forbes, Jr. | 229/120.08 |
| 5,495,983 | 3/1996 | Lelek | 229/120.13 |
| 5,775,573 | 7/1998 | Smith | 229/120.14 |
| 5,971,265 | 10/1999 | Collins | 229/120.13 |

*Primary Examiner*—Gary E. Elkins
*Attorney, Agent, or Firm*—William H. Pavitt, Jr.; David A. Belasco; Natan Epstein

[57] ABSTRACT

A reinforced paperboard box for storage and shipping of elongated items is described. The box is formed from a single piece of paperboard and may be rapidly assembled without the use of tools. The box comprises an elongated rectangular bottom panel, first and second joined side panels, a top panel, a front reinforcing panel and dividing partition all foldably joined at elongated edges and constructed to form a multi-level elongated box. The first side panel has a pair of abutting end panels foldably joined to either end, with a tab receiving panel and a locking panel foldably joined to either side of the end panel. The second side panel has a pair of end panels foldably joined to either end, that are locked in place by the locking panels and tab receiving panels of the first side panel. The dividing partition includes at least two pair of cuts and a series of perforations enabling the dividing partition to be folded inwardly so as to divide the interior space of the box into at least two compartments while providing additional strength and resistance to bending and crushing forces. Variations of the invention include an additional strengthening panel foldably joined to the dividing partition. Other variations include a provision for a half-width partition and various cuts and perforations to provide for specially shaped compartments for accessories such as golf balls and videocassettes. Further variations provide for structural cells and for container shortening panels and positioning panels at the container ends.

20 Claims, 12 Drawing Sheets

Fig. 10
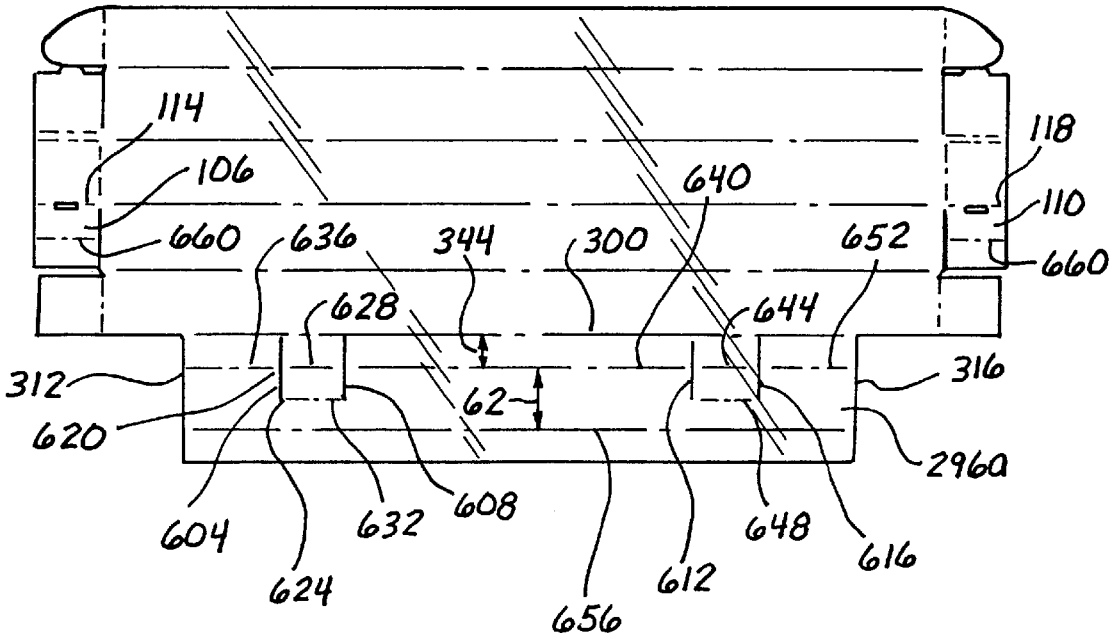
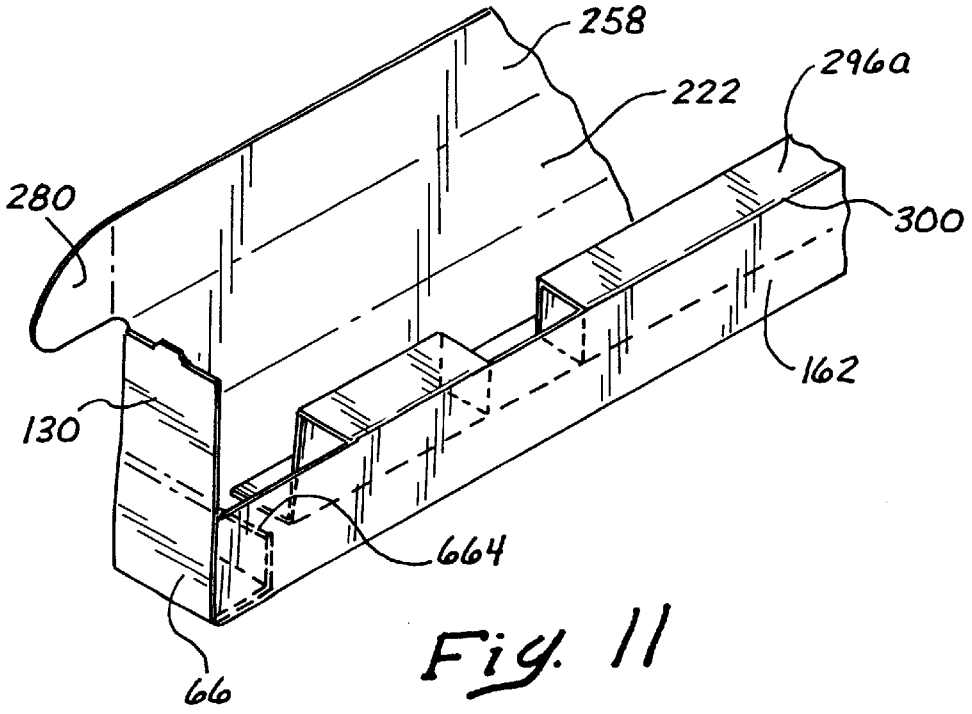
Fig. 11

Fig. 18
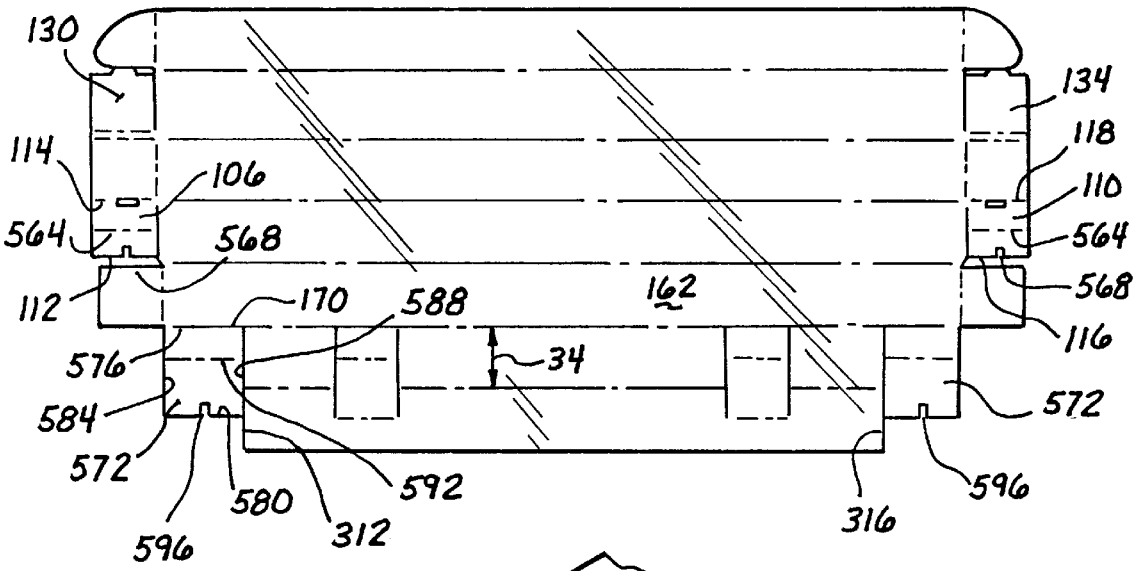
Fig. 19
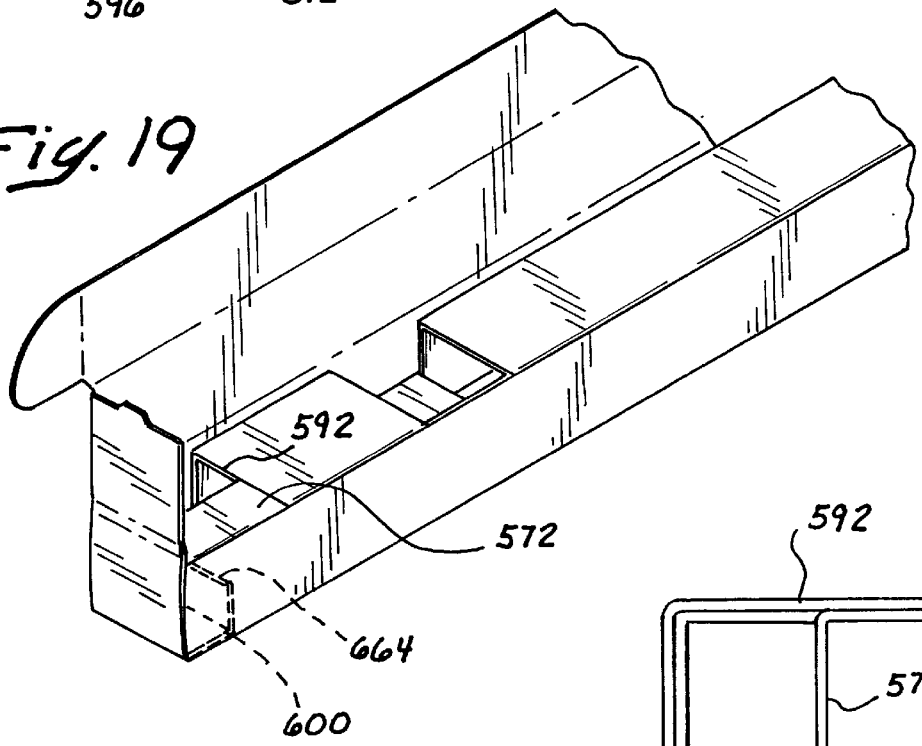
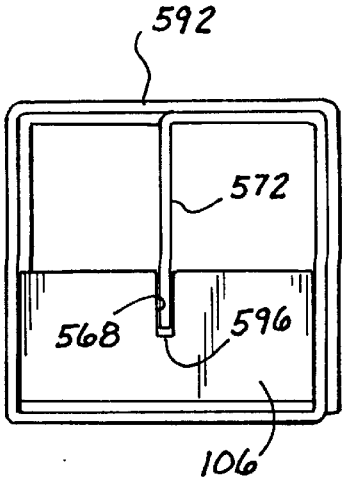
Fig. 20

REINFORCED PAPERBOARD BOX FOR STORAGE AND SHIPPING OF ELONGATED ITEMS

NOTICE OF RELATED APPLICATION

The subject matter of this application is related to copending application Ser. No. 09/140,789 filed Aug. 27, 1998.

FIELD OF INVENTION

The invention pertains to a paperboard box construction. More particularly, the invention relates to a box construction adapted for storage and shipping of items that must be protected from crushing, folding or bending forces.

BACKGROUND OF THE INVENTION

Various types of paperboard boxes, tubes and containers have been devised to protect elongated articles during shipment.

U.S. Pat. No. 2,604,255, issued to Welshenbach, describes a container having a knock-down body made from a one-piece blank of material such as paperboard. The container has end walls stiffened by flaps projecting into the container and serving as partitions to separate the contents of the container. U.S. Pat. No. 1,623,547, issued to Neumann, discloses an elongated, trapezoidal box for shipping and display of golf clubs, formed from a single blank of paperboard material.

U.S. Pat. No. 2,253,008, issued to Anderson, describes a display box for golf clubs that may also be used for shipping. The box includes slotted divider panels to prevent the clubs from contacting one another during shipping. Another U.S. Pat. No. 4,236,740, issued to Anderson, illustrates another golf club box having a slotted cross bar construction disposed between the spaced apart sides of the box designed to receive the shanks of golf clubs and keep them from damaging each other in shipping. A separate cover is provided for the box.

U.S. Pat. No. 5,495,983, issued to Lelek is directed to a shipping and storage container with an integral divider insert-forming portion. The portion is formed of an innermost insert panel, a center, hold down panel and an outermost insert panel. When the insert-forming portion is folded inwardly toward bottom wall-forming panel, it serves to separate container into separate upper and lower spaces that are accessible throughout their entire length from the top of the container, from time to time, during positioning of the divider panels within the open container.

An effective design for a shipping container for such items must necessarily be a compromise of various factors. It is an objective of the present invention that the container provide the required degree of protection from the forces encountered in transferring the container from one destination to another by means of automated package handling systems, trucks, automobiles and aircraft. In particular, the container should provide protection from bending moments applied to the length of the container. It is another objective of the invention that dividers be provided to segregate the contents of the container to prevent damage to individual items stored within the container. It is a further objective that the container be light in weight to prevent excessive shipping costs. It is yet a further objective of the invention that the container is economical to produce and simple to assemble. It is a still further objective that the container provide a simple and effective means of being sealed and later opened.

While features disclosed in the prior art satisfy some of the objectives of the present invention, none of the inventions found include all of the requirements identified.

SUMMARY OF THE INVENTION

The present invention addresses all of the deficiencies of prior art reinforced paperboard boxes and satisfies all of the objectives described above. A reinforced paperboard box for storage and shipping of elongated items may be formed from a single blank of paperboard material comprising the following components. A rectangular bottom panel is provided having first and second opposed, elongated, parallel, side edges. The bottom panel has third and fourth opposed, parallel end edges normal to the first and second edges, a first predetermined width measured between the first and second edges and a first predetermined length measured between the third and fourth edges.

A first side panel is provided having first and second opposed, elongated, parallel edges of the first predetermined length, third and fourth opposed, parallel end edges, a first predetermined height measured between the first and second edges. The first side panel is foldably joined at its second edge to the first edge of the bottom panel.

First and second abutting rectangular first side end panels are provided, each of the first side end panels having first and second opposed, parallel edges of the length of the first predetermined width. The first side end panels have third and fourth opposed, parallel edges of the the length of the first predetermined height. The first first side end panel is foldably joined at its fourth edge to the third edge of the first side panel and the second first side end panel foldably joined at its third edge to the fourth edge of the first side panel.

First and second tab receiving panels are provided, each of the tab receiving panels having a distal edge and a proximate edge not greater in length than the first predetermined width and being foldably joined at the proximate edge to the second edge of one of the first and second first side end panels. Each of the first and second tab receiving panels including a tab opening located along its proximate edge.

First and second locking panels are provided, each of the locking panels having a proximate edge not greater in length than the first predetermined width, and an opposed parallel, distal edge. The locking panels are foldably joined at the proximate edge to the first edge of one of the first and second first side end panels. Each of the first and second locking panels includes a tab member extending outwardly from its distal edge, the tab member sized, shaped and located to engage the tab opening in one of the first and second tab receiving panels.

A second side panel is provided having first and second opposed, elongated, parallel edges of the first predetermined length, third and fourth opposed, parallel end edges, of the first predetermined height measured between the first and second edges. The second panel is foldably joined at its first edge to the second edge of the bottom panel.

First and second abutting rectangular second side end panels are provided. Each of the second side end panels has first and second opposed, parallel edges of the length of the first predetermined width and third and fourth opposed, parallel edges of the length of the first predetermined height. The first second side end panel is foldably joined at its fourth edge to the third edge of the second side panel and the second second side end panel is foldably joined at its third edge to the fourth edge of the second side panel.

A top panel is provided having first and second opposed, elongated, parallel edges of less than the first predetermined length, spaced apart by the first predetermined width, and third and fourth opposed, parallel end edges. The top panel is foldably joined at its second edge to the first edge of the first side panel.

A front reinforcing panel is provided having first and second opposed, elongated, parallel edges of the first predetermined length, spaced apart by no more than the first predetermined height, and third and fourth opposed, parallel end edges. The front reinforcing panel is foldably joined at its second edge to the first edge of the top panel.

First and second front panel end extensions are provided. Each of the end extensions having a proximate edge not greater in length than the first predetermined height. The front panel end extensions are foldably joined at the proximate edge to one of the third and fourth edges of the front reinforcing panel.

A dividing partition is provided having first and second opposed, elongated, parallel edges of a second predetermined length, less than the first predetermined length, spaced apart a second predetermined width equal to the sum of the first predetermined width and the first predetermined height. The dividing partition has third and fourth opposed, parallel end edges. The dividing partition is foldably joined at its first edge to the second edge of the second side panel.

The dividing partition includes at least two pairs of cuts. The first cut is spaced from the third edge of the dividing partition and the second cut is spaced from the first cut. The third cut is spaced from the fourth edge of the dividing partition and the forth cut is spaced from the third cut. Each of the first, second, third and fourth cuts extend from the first edge of the dividing partition to a first point spaced from the first edge by a first predetermined distance. The cuts then extend from the first point to a second point spaced from the first edge by the first predetermined width, and from the second point to a third point. The third point is spaced from the second edge of the dividing partition by a second predetermined distance.

A first perforation parallel to the first edge of the dividing partition is provided. The first perforation extends from the first point of the first cut to the first point of the second cut. A second perforation parallel to the first edge of the dividing partition is provided. The second perforation extends from the third point of the first cut to the third point of the second cut. A third perforation parallel to the first edge of the dividing partition is provided. The third perforation extends from the second point of the first cut to the third edge of the dividing partition.

A fourth perforation parallel to the first edge of the dividing partition is provided. The fourth perforation extends from the second point of the second cut to the second point of the third cut. A fifth perforation parallel to the first edge of the dividing partition is provided. The fifth perforation extends from the first point of the third cut to the first point of the fourth cut. A sixth perforation parallel to the first edge of the dividing partition is provided. The sixth perforation extends from the third point of the third cut to the third point of the fourth cut. A seventh perforation parallel to the first edge of the dividing partition is provided, the seventh perforation extends from the second point of the fourth cut to fourth edge of the dividing partition.

To assemble the reinforced paperboard box for storage and shipping of elongated items the first and second tab receiving panels are folded inwardly from the first and second first side end panels. The first and second first side end panels are next folded inwardly from the first side panel, and the first side panel is folded inwardly from the bottom panel. The first and second second side end panels are then folded inwardly from the second side panel, and the second side panel is folded inwardly from the bottom panel.

Next, the first and second locking panels are folded over the first and second second side end panels so that the tab members of the first and second locking panels engage the tab openings of the first and second tab receiving panels. The dividing partition is then folded inwardly along the first, second, third, fourth, fifth, sixth and seventh perforations and inwardly from the second side panel so that its second edge rests upon the bottom panel. Thus, an open topped container divided into a plurality of compartments may be formed.

A closed reinforced paperboard box for storage and shipping of elongated items may be formed by folding the top panel inwardly from the first side panel and folding the first and second front panel extensions inwardly from the front reinforcing panel. Next, the front reinforcing panel is folded inwardly from the top panel and over the second side panel. Next, the first front panel extension is inserted between the first first side end panel and the first second side end panel and the second front panel extension is inserted between the second first side end panel and the second second side end panel.

A variant of the invention includes a compartment accommodating an accessory such as a videocassette. In this variant fifth and sixth cuts are provided. Each of the fifth and sixth cuts extends from the first edge of the dividing partition for a third predetermined distance. The fifth and sixth cuts are spaced apart by a distance slightly less than the width of a videocassette. Seventh and eighth cuts are also provided. The seventh cut extends along the first edge of the dividing partition from the fifth cut toward the third edge of the dividing partition for a fourth predetermined distance. The eighth cut extends along the first edge of the dividing partition from the sixth cut toward the fourth edge of the dividing partition for the fourth predetermined distance.

Ninth and tenth cuts are provided. The ninth cut extends orthogonally from the intersection of the seventh cut and the first edge of the dividing partition into the second side panel for a fifth predetermined distance, the distance slightly greater than the thickness of a videocassette. The tenth cut extends orthogonally from the intersection of the eighth cut and the first edge of the dividing partition into the second side panel for the fifth predetermined distance.

An eighth perforation parallel to the first edge of the dividing partition is provided. The eighth perforation extends from the ninth cut to the tenth cut at the fifth predetermined distance from the first edge of the dividing partition. A ninth perforation parallel to the first edge of the dividing partition is provided. The ninth perforation extends from the fifth cut to the sixth cut at the third predetermined distance from the first edge of the dividing partition. A tenth perforation parallel to the first edge of the dividing partition is provided. The tenth perforation extends from the fifth cut to the sixth cut at the fifth predetermined distance from the ninth perforation.

In use, the dividing partition is folded inwardly along the first through tenth perforations and folded inwardly so that its second edge rests on the bottom panel. In this way a container divided into a plurality of compartments, including one sized, shaped and located to contain a videocassette may be formed.

Another variant of the invention includes a compartment designed to accommodate golf accessories such as a set of golf balls. In this variant eleventh and twelfth cuts are provided. Each of the eleventh and twelfth cuts have a first end and a second end and extend from the first edge of the dividing partition into the dividing partition and into the second side panel for a sixth predetermined distance. The eleventh and twelfth cuts are spaced apart by a distance sufficient to accommodate golf accessories such as a set of golf balls.

An eleventh perforation parallel to the first edge of the dividing partition is provided. The eleventh perforation extends from the first end of the eleventh cut to the first end of the twelfth cut at the sixth predetermined distance from the first edge of the dividing partition. A twelfth perforation parallel to the first edge of the dividing partition is provided. The twelfth perforation extends from the eleventh cut to the twelfth cut along the first edge of the dividing partition. A thirteenth perforation parallel to the first edge of the dividing partition is provided. The thirteenth perforation extends from the second end of the eleventh cut to the second end of the twelfth cut at the sixth predetermined distance from the first edge of the dividing partition.

In use, the dividing partition is folded inwardly along the first through seventh and eleventh through thirteenth perforations. The partition is then folded inwardly so that its second edge rests on the bottom panel. Thus a container divided into a plurality of compartments, including a compartment sized, shaped and located to contain golf accessories such as a set of golf balls, may be formed.

In yet another variant of the invention, the first and second tab receiving panels further include a score line. The score line is parallel to and spaced from the proximate edge of each of the tab receiving panels. When the tab receiving panels are bent upwardly at the score line, a support platform will be provided within the container at either end.

In still another variant, a strengthening panel is provided. The strengthening panel has first and second opposed, elongated, parallel edges no longer than the first predetermined length and spaced apart by the first predetermined height, and third and fourth opposed end edges. The strengthening panel is foldably joined at its first edge to the second edge of the dividing partition.

In use, the strengthening panel is folded outwardly along its first edge and the dividing partition is folded inwardly along its first edge and first through seventh perforations. The dividing partition and the strengthening panel may then be inserted into the open-topped container, thereby proving the container with four vertical panels, including the first and second side panels, the dividing partition and the strengthening panel, to resist bending and crushing forces.

In yet a further variant of the invention, at least one box-shortening flap is provided. The shortening flap has first and second opposed, parallel edges spaced apart by the first predetermined width and proximate and distal opposed, parallel edges spaced apart by the first predetermined height. The flap is foldably joined at its proximate edge to one of the third and fourth edges of the dividing partition adjacent its first edge.

When the box shortening flap is folded downwardly from one of the third and fourth edges of the dividing partition and the dividing partition is inserted into the open-topped container, the compartments formed within the container will be shortened and a small, additional compartment will be formed within the container.

In still a further variant, at least one positioning panel is provided. The positioning panel has first and second opposed, parallel edges spaced apart by the first predetermined width. It also has proximate and distal opposed, parallel edges spaced apart by the distance from one of the third and fourth edges of the dividing partition to one of the first and second locking panels. The positioning panel is foldably joined at its proximate edge to the distal edge of the shortening flap.

In use, the box shortening flap is folded downwardly from one of the third and fourth edges of the dividing partition and the positioning panel is folded upwardly from the shortening flap. The dividing partition is then inserted into the open-topped container. The shortening flap will then be fixedly positioned within the container and the compartments formed within the container will be shortened and a small, additional compartment will be formed in the container.

In another variant of the invention, at least one first score line is provided. The first score line is parallel to and spaced from the proximate edge of each of the tab receiving panels. A first notch is provided. The first notch extends from the distal edge of the tab receiving panel orthogonally toward the first score line.

At least one cell-forming panel is provided. The cell forming panel has first and second opposed, parallel edges spaced apart by the sum of the first predetermined height and one half of the first predetermined width. The cell forming panel also has and third and fourth opposed parallel edges spaced apart by the distance between one of the third and fourth edges of the dividing partition and one of the first and second locking panels. The cell-forming panel is foldably joined at its first edge to the second edge of the second side panel and includes a second score line. The second score line is spaced from the second edge by one half of the first predetermined width. A second notch is provided. The second notch extends from the second edge of the cell-forming panel orthogonally toward the second score line.

In use, the open-topped container is assembled and the tab receiving panel is folded upwardly at its score line. The cell-forming panel is then folded inwardly from the second edge of the second side panel. When this has been done, the second notch of the cell-forming panel will engage the first notch of the tab-receiving panel to form a cell within the container. When the dividing partition is folded inwardly from the second side panel and inserted into the open-topped container, a container having a plurality of compartments will be formed.

In yet another variant of the invention, the dividing partition includes at least two pairs of cuts. The first cut is spaced from the third edge of the dividing partition and the second cut is spaced from the first cut, the third cut is spaced from the forth cut and the forth cut is spaced from the fourth edge of the dividing partition. Each of the first, second, third and fourth cuts extend from the first edge of the dividing partition to a first point spaced from the first edge by the first predetermined distance. The cuts then extend from the first point to a second point spaced from the first edge by one half the first predetermined width.

A first perforation parallel to the first edge of the dividing partition is provided. The first perforation extends from the first point of the first cut to the first point of the second cut. A second perforation parallel to the first edge of the dividing partition is provided. The second perforation extends from the second point of the first cut to the second point of the second cut. A third perforation parallel to the first edge of the dividing partition is provided. The third perforation extends from the first point of the first cut to the third edge of the dividing partition. A fourth perforation parallel to the first edge of the dividing partition is provided. The fourth perforation extends from the first point of the second cut to the first point of the third cut.

A fifth perforation parallel to the first edge of the dividing partition is provided. The fifth perforation extends from the first point of the third cut to the first point of the fourth cut. A sixth perforation parallel to the first edge of the dividing partition is provided. The sixth perforation extends from the second point of the third cut to the second point of the fourth cut. A seventh perforation parallel to the first edge of the dividing partition is provided, the seventh perforation extends from the first point of the fourth cut to fourth edge of the dividing partition. An eighth perforation parallel to the first edge of the dividing partition is provided. The eighth perforation extends from the third edge of the dividing partition to the fourth edge of the dividing partition. The eighth perforation is spaced from the fourth perforation by the first predetermined height.

In use, the first and second tab receiving panels are folded inwardly from the first and second first side end panels. The first and second first side end panels are then folded inwardly from the first side panel, and the first side panel is folded inwardly from the bottom panel. Next, the first and second second side end panels are folded inwardly from the second side panel, and the second side panel is folded inwardly from the bottom panel.

Next, the first and second locking panels are folded over the first and second second side end panels so that the tab members of the second side end panels engage the tab openings of the first and second tab receiving panels. The dividing partition is then folded inwardly along the first through seventh perforations and outwardly along the eighth perforation. The dividing partition is then folded inwardly from the second side panel so that the eighth perforation rests upon the bottom panel and the second edge of the dividing partition abuts the first side panel. In this manner, an open topped container divided into a plurality of compartments may be formed.

A closed reinforced paperboard box for storage and shipping of elongated items may be formed by folding the top panel inwardly from the first side panel and folding the first and second front panel extensions inwardly from the front reinforcing panel. Next, the front reinforcing panel is folded inwardly from the top panel and over the second side panel. Next, the first front panel extension is inserted between the first first side end panels and the first second side end panel and the second front panel extension is inserted between the second first side end panels and the second second side end panel.

In a final variation, the first and second tab receiving panels of the previously described variant further include a score line. The score line is parallel to and spaced from the proximate edge of each of said tab receiving panels. When the tab receiving panels are bent upwardly at the score line, a support platform will be provided within the container at either end.

DESCRIPTION OF THE DRAWINGS

FIG. 10 is a plan view of a fourth embodiment of the invention providing a half width dividing partition;

FIG. 11 is a perspective view of one end of the FIG. 10 embodiment illustrating the half width dividing partition;

FIG. 18 is a plan view of a eighth embodiment of the invention providing a cell at either end of the dividing partition;

FIG. 19 is a perspective view of one end of the FIG. 18 embodiment illustrating the cell in place in the container;

FIG. 20 is a cross-sectional view of the FIG. 18 embodiment illustrating the formation of the cell;

DETAILED DESCRIPTION OF THE PREFERRED EMBODIMENT

Figure 1:
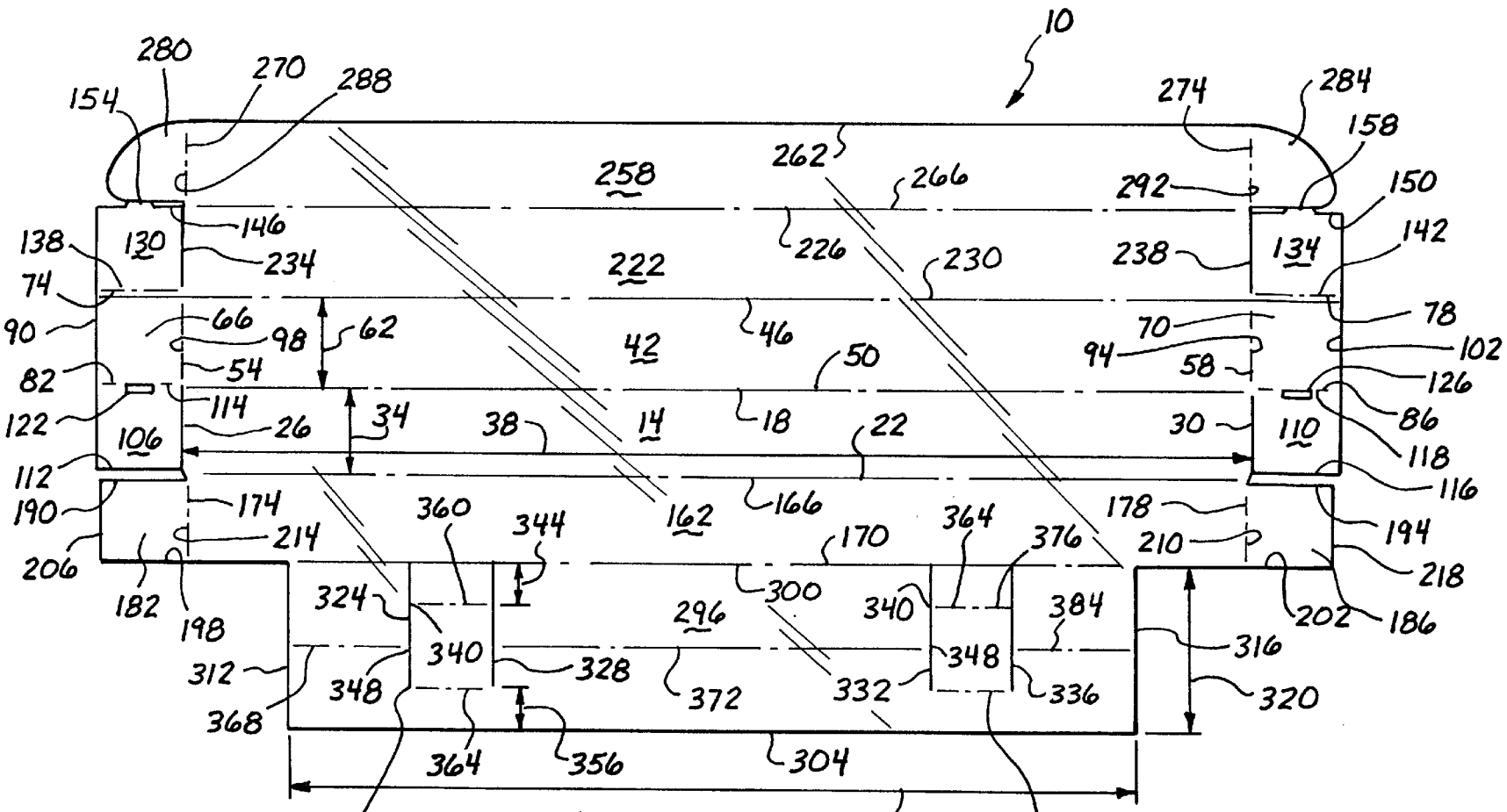
FIG. 1 is a plan view of the preferred embodiment of the invention.
Figure 2:
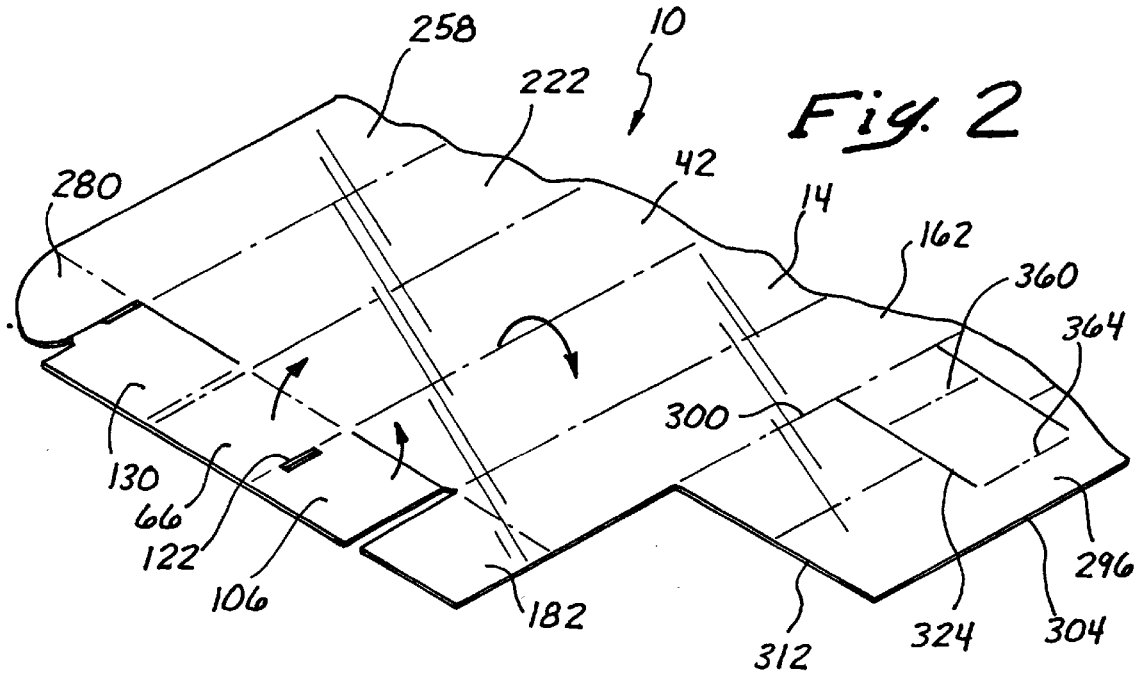
FIG. 2 is a perspective view of one end of the FIG. 1 embodiment illustrating the directions of the first three folds to assemble the container.
Figure 3:
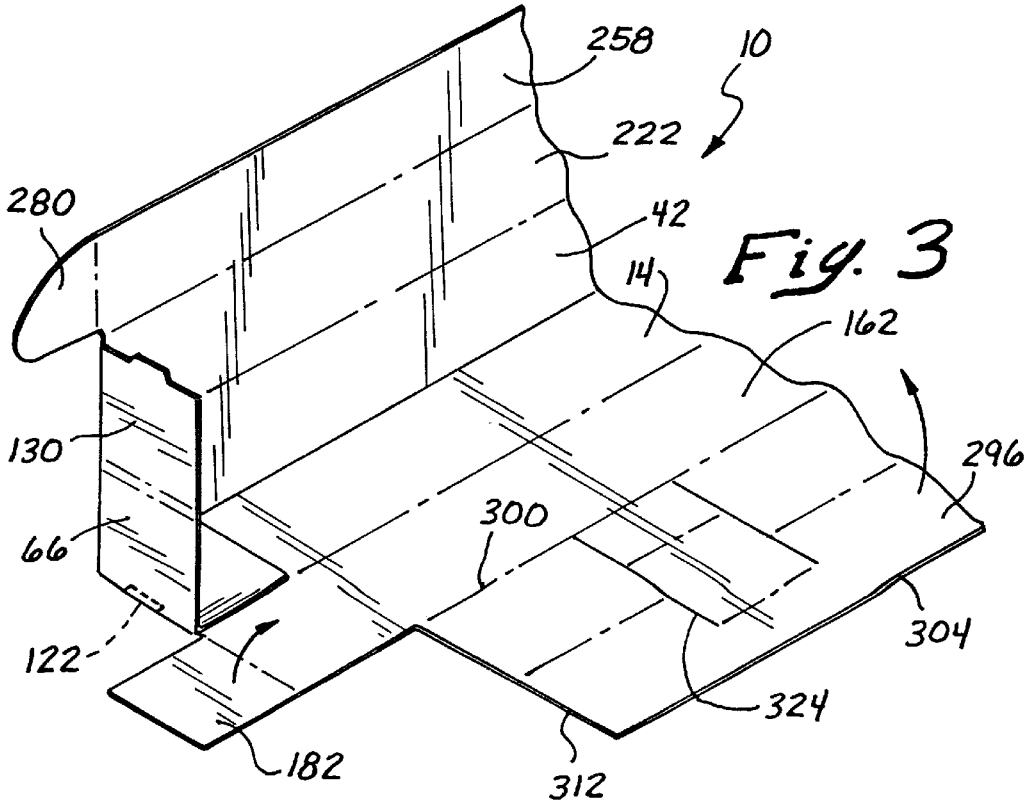
FIG. 3 is a perspective view of one end of the FIG. 1 embodiment illustrating the first side panel folded at a right angle to the bottom panel, the first first side end panel folded inwardly from the first side panel and the first tab receiving panel folded inwardly from the first first side end panel.
Figure 4:
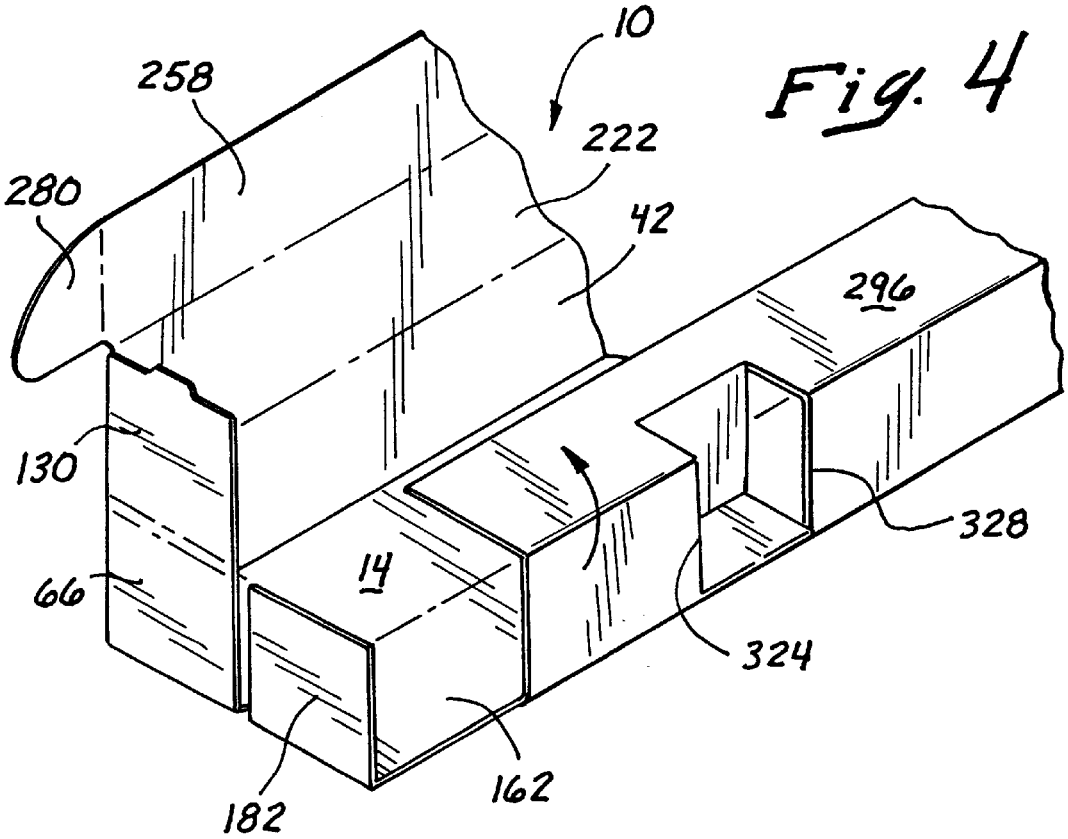
FIG. 4 is a perspective view of one end of the FIG. 1 embodiment illustrating the first second side end panel folded inwardly from the second side panel and the dividing partition folded inwardly from the second side panel.
Figure 5:
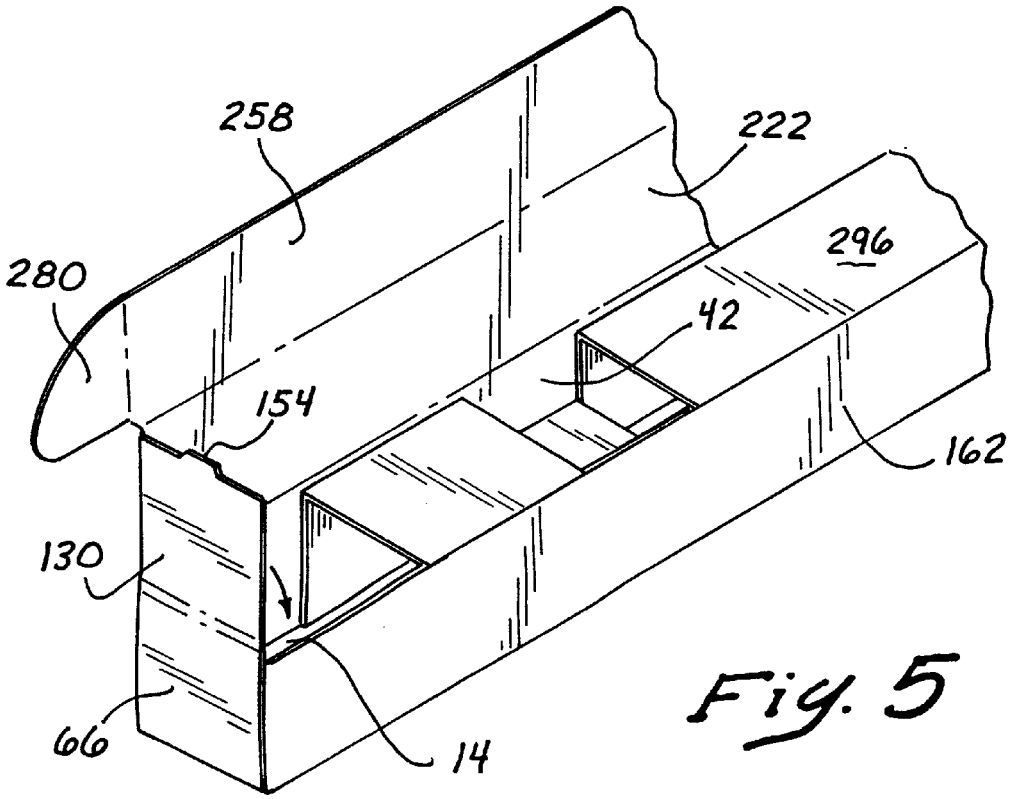
FIG. 5 is an perspective view of one end of the FIG. 1 embodiment illustrating the second side panel folded inwardly from the bottom panel and the formation of two compartments within the container.

FIG. 1 illustrates a die-cut blank for a reinforced paperboard box 10 for storage and shipping of elongated items. As shown in FIGS. 1–5, the invention comprises the following components. A rectangular bottom panel 14 is provided having first 18 and second 22 opposed, elongated, parallel, side edges. The bottom panel 14 has third 26 and fourth 30 opposed, parallel end edges normal to the first 18 and second 22 edges, a first predetermined width 34 measured between the first 18 and second 22 edges and a first predetermined length 38 measured between the third 26 and fourth 30 edges.

A first side panel 42 is provided having first 46 and second 50 opposed, elongated, parallel edges of the first predetermined length 38, third 54 and fourth 58 opposed, parallel end edges, a first predetermined height 62 measured between the first 46 and second 50 edges. The first side panel 42 is foldably joined at its second edge 50 to the first edge 18 of the bottom panel 14.

First 66 and second 70 abutting rectangular first side end panels are provided, each of the first side end panels 66, 70 having first 74, 78 and second 82, 86 opposed, parallel edges of the length of the first predetermined width 34. The first side end panels 66, 70 have third 90, 94 and fourth 98, 102 opposed, parallel edges of the length of the first predetermined height 62. The first 66 first side end panel is foldably joined at its fourth edge 98 to the third edge 54 of the first side panel 42 and the second 70 first side end panel foldably joined at its third edge 94 to the fourth edge 58 of the first side panel 42.

First 106 and second 110 tab receiving panels are provided, each of the tab receiving panels 106, 110 having a distal edge 112, 116 and a proximate edge 114, 118 not greater in length than the first predetermined width 34 and being foldably joined at the proximate edge 114, 118 to the second edge 82, 86 of one of the first 66 and second 70 first side end panels. Each of the first 106 and second 110 tab receiving panels including a tab opening 122, 126 located along its proximate edge 114, 118.

First 130 and second 134 locking panels are provided, each of the locking panels 130, 134 having a proximate edge 138, 142 not greater in length than the first predetermined width 34, and an opposed parallel, distal edge 146, 150. The locking panels 130, 134 are foldably joined at the proximate edge 138, 142 to the first edge 74, 78 of one of the first 66 and second 70 first side end panels. Each of the first 130 and second 134 locking panels includes a tab member 154, 158 extending outwardly from its distal edge 146, 150, the tab member 154, 158 sized, shaped and located to engage the tab opening 122, 126 in one of the first 106 and second 110 tab receiving panels.

A second side panel 162 is provided having first 166 and second 170 opposed, elongated, parallel edges of the first predetermined length 38, third 174 and fourth 178 opposed, parallel end edges, of the first predetermined height measured between the first 166 and second 170 edges. The second panel 162 is foldably joined at its first 166 edge to the second 22 edge of the bottom panel 14.

First 182 and second 186 abutting rectangular second side end panels are provided. Each of the second side end panels 182, 186 has first 190, 194 and second 198, 202 opposed, parallel edges of the length of the first predetermined width 34 and third 206, 210 and fourth 214, 218 opposed, parallel edges of the length of the first predetermined height 38. The first 182 second side end panel is foldably joined at its fourth 214 edge to the third 174 edge of the second side panel 162 and the second 186 second side end panel is foldably joined at its third edge 210 to the fourth 178 edge of the second side panel 162.

A top panel 222 is provided having first 226 and second 230 opposed, elongated, parallel edges of less than the first predetermined length 38, spaced apart by the first predetermined width 34, and third 234 and fourth 238 opposed, parallel end edges. The top panel 222 is foldably joined at its second 230 edge to the first 46 edge of the first side panel 42.

A front reinforcing panel 258 is provided having first 262 and second 266 opposed, elongated, parallel edges of the first predetermined length 38, spaced apart by no more than the first predetermined height 62, and third 270 and fourth 274 opposed, parallel end edges. The front reinforcing panel 258 is foldably joined at its second 266 edge to the first 226 edge of the top panel 222.

First 280 and second 284 front panel end extensions are provided. Each of the end extensions 280, 284 has a proximate edge 288, 292 not greater in length than the first predetermined height 62. The front panel end extensions 280, 284 are foldably joined at the proximate edge 288, 292 to one of the third 270 and fourth 274 edges of the front reinforcing panel 258.

A dividing partition 296 is provided having first 300 and second 304 opposed, elongated, parallel edges of a second predetermined length 308, less than the first predetermined length 38, spaced apart a second predetermined width 320 equal to the sum of the first predetermined width 34 and the first predetermined height 38. The dividing partition 296 has third 312 and fourth 316 opposed, parallel end edges. The dividing partition 296 is foldably joined at its first 300 edge to the second 170 edge of the second side panel 162.

The dividing partition 296 includes at least two pairs of cuts 324, 328, 332, 336. The first cut 324 is spaced from the third edge 312 of the dividing partition 296 and the second cut 328 is spaced from the first cut 324. The third cut 332 is spaced from the fourth edge 316 of the dividing partition 296 and the forth cut 336 is spaced from the third cut 332. Each of the first 324, second 328, third 332 and fourth 336 cuts extend from the first edge 300 of the dividing partition 296 to a first point 340 spaced from the first edge 300 by a first predetermined distance 344. The cuts 324, 328, 332, 336 then extend from the first point 340 to a second point 348 spaced from the first edge 300 by the first predetermined width 34, and from the second point 348 to a third point 352. The third point 352 is spaced from the second edge 304 of the dividing partition 296 by a second predetermined distance 356.

A first perforation 360 parallel to the first edge 300 of the dividing partition 296 is provided. The first perforation 360 extends from the first point 340 of the first cut 324 to the first point 340 of the second cut 328. A second perforation 364 parallel to the first edge 300 of the dividing partition 296 is provided. The second perforation 364 extends from the third point 352 of the first cut 324 to the third point 352 of the second cut 328. A third perforation 368 parallel to the first edge 300 of the dividing partition 296 is provided. The third perforation 368 extends from the second point 348 of the first cut 324 to the third edge 312 of the dividing partition 296.

A fourth perforation 372 parallel to the first edge 300 of the dividing partition 296 is provided. The fourth perforation 372 extends from the second point 348 of the second cut 328 to the second point 348 of the third cut 332. A fifth perforation 376 parallel to the first edge 300 of the dividing partition 296 is provided. The fifth perforation 376 extends from the first point 340 of the third cut 332 to the first point 340 of the fourth cut 336. A sixth perforation 380 parallel to the first edge 300 of the dividing partition 296 is provided. The sixth perforation 380 extends from the third point 352 of the third cut 332 to the third point 352 of the fourth cut 336. A seventh perforation 384 parallel to the first edge 300 of the dividing partition 296 is provided, the seventh perforation 384 extends from the second point 348 of the fourth cut 336 to fourth edge 316 of the dividing partition.

To assemble the improved reinforced paperboard box for storage and shipping of elongated items 10 the first 106 and second 110 tab receiving panels are folded inwardly from the first 66 and second 70 first side end panels. The first 66 and second 70 first side end panels are next folded inwardly from the first side panel 42, and the first side panel 42 is folded inwardly from the bottom panel 14. The first 182 and second 186 second side end panels are then folded inwardly from the second side panel 162, and the second side panel 162 is folded inwardly from the bottom panel 14.

Next, the first 130 and second 134 locking panels are folded over the first 182 and second 186 second side end panels so that the tab members 154, 158 of the first 130 and second 134 locking panels engage the tab openings 122, 126 of the first 106 and second 110 tab receiving panels. The dividing partition 296 is then folded inwardly along the first 360, second 364, third 368, fourth 372, fifth 376, sixth, 380 and seventh 384 perforations and inwardly from the second side panel 162 so that its second 304 edge rests upon the bottom panel 14. Thus, an open topped container divided into a plurality of compartments may be formed.

A closed improved reinforced paperboard box for storage and shipping of elongated items 10 may be formed by folding the top panel 222 inwardly from the first side panel and folding the first 280 and second 284 front panel extensions inwardly from the front reinforcing panel 258. Next, the front reinforcing panel 258 is folded inwardly from the top panel 222 and over the second side panel 162, and the first 280 front panel extension is inserted between the first 66 first side end panel and the first 182 second side end panel and the second 284 front panel extension is inserted between the second 70 first side end panel and the second 186 second side end panel.

Figure 21:
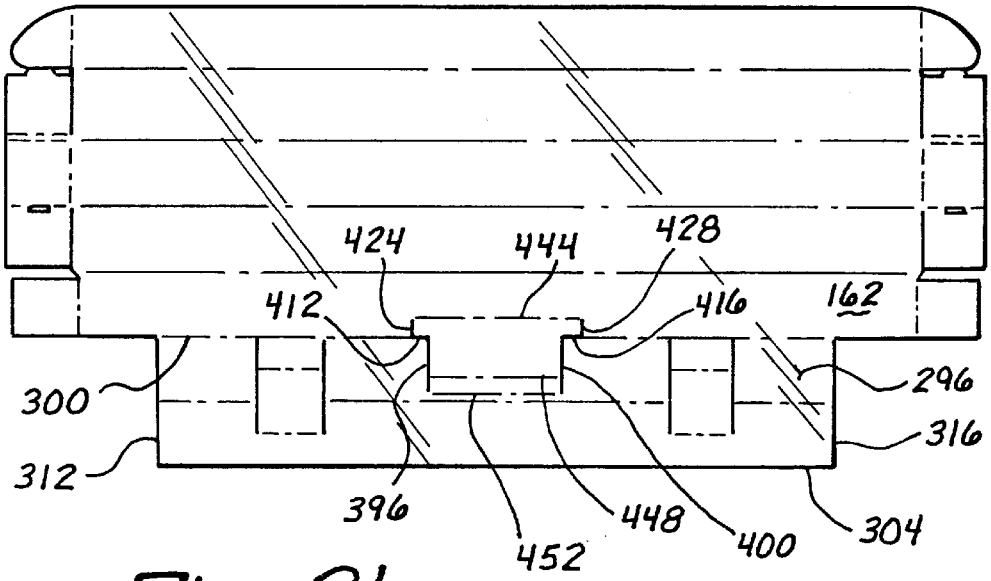
FIG. 21 is a plan view of a ninth embodiment of the invention providing a compartment for an accessory such as a videocassette.
Figure 22:
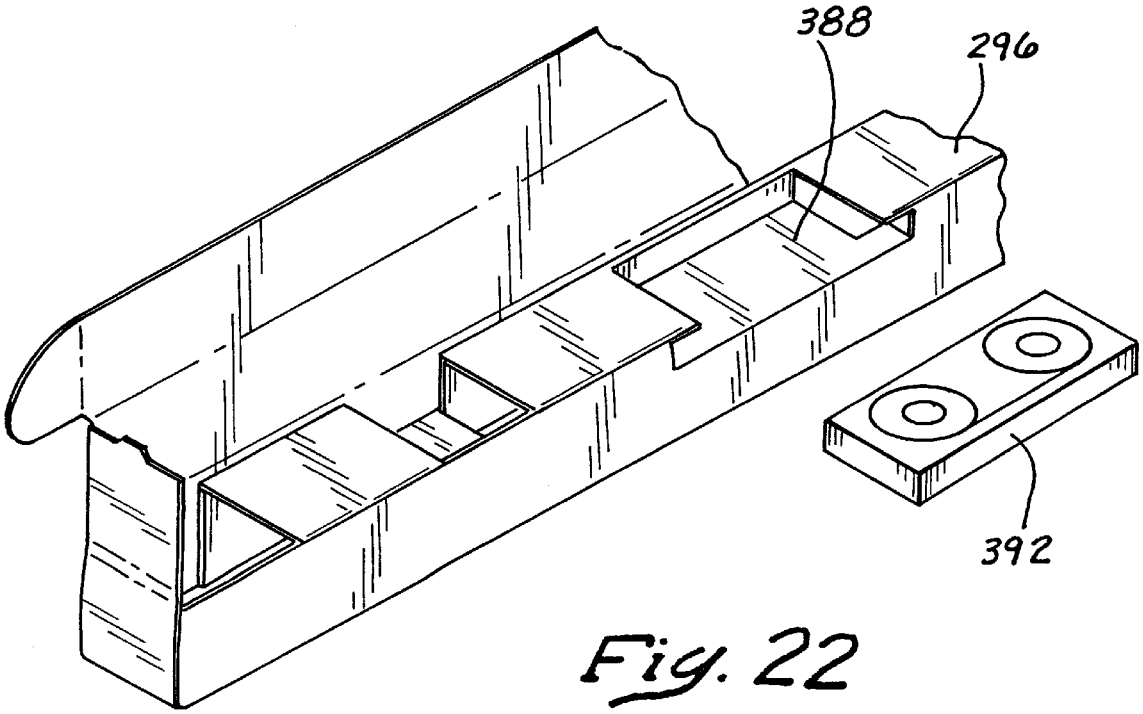
FIG. 22 is a perspective view of one end of the FIG. 21 embodiment illustrating the accessory compartment formed in the container.
Figure 21A:
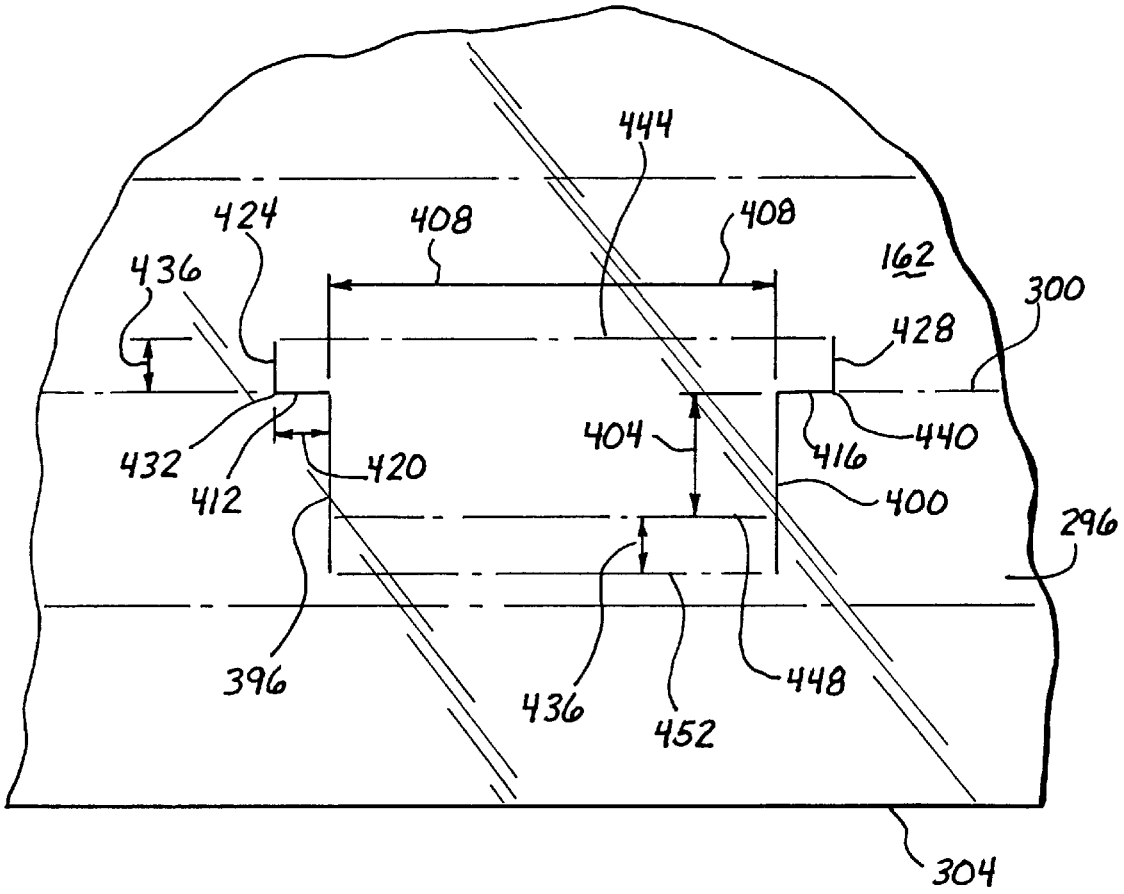
FIG. 21*a* is an enlarged plan view of a ninth embodiment of the invention illustrating the details of the structure of the accessory compartment.

As illustrated in FIGS. 21, 21*a* and 22, a variant of the invention includes a compartment 388 accommodating an accessory such as a videocassette 392. In this variant fifth 396 and sixth 400 cuts are provided. Each of the fifth 396 and sixth 400 cuts extends from the first edge 300 of the dividing partition 296 for a third predetermined distance 404. The fifth 396 and sixth 400 cuts are spaced apart by a distance 408 slightly less than the width of a videocassette 392. Seventh 412 and eighth 416 cuts are also provided. The seventh cut 412 extends along the first edge 300 of the dividing partition 296 from the fifth cut 396 toward the third edge 312 of the dividing partition 296 for a fourth predetermined distance 420. The eighth cut 416 extends along the first edge 300 of the dividing partition 296 from the sixth cut 400 toward the fourth edge 316 of the dividing partition 296 for the fourth predetermined distance 420.

Ninth 424 and tenth 428 cuts are provided. The ninth cut 424 extends orthogonally from the intersection 432 of the seventh cut 412 and the first edge 300 of the dividing partition 296 into the second side panel 162 for a fifth predetermined distance 436, the distance slightly greater than the thickness of a videocassette 392. The tenth cut 428 extends orthogonally from the intersection 440 of the eighth cut 416 and the first edge 300 of the dividing partition 296 into the second side panel 162 for the fifth predetermined distance 436.

An eighth perforation 444 parallel to the first edge 300 of the dividing partition 296 is provided. The eighth perforation 444 extends from the ninth cut 424 to the tenth cut 428 at the fifth predetermined distance 436 from the first edge 300 of the dividing partition 296. A ninth perforation 448 parallel to the first edge 300 of the dividing partition 296 is provided. The ninth perforation 448 extends from the fifth cut 396 to the sixth cut 400 at the third predetermined distance 404 from the first edge 300 of the dividing partition 296. A tenth perforation 452 parallel to the first edge 300 of the dividing partition 296 is provided. The tenth perforation 452 extends from the fifth cut 396 to the sixth cut 400 at the fifth predetermined distance 436 from the ninth perforation 448.

In use, the dividing partition 296 is folded inwardly along the first 360 through tenth 452 perforations and folded inwardly so that its second edge 304 rests on the bottom panel 14. In this way a container divided into a plurality of compartments, including one sized, shaped and located to contain a videocassette 392 may be formed.

Figure 6:
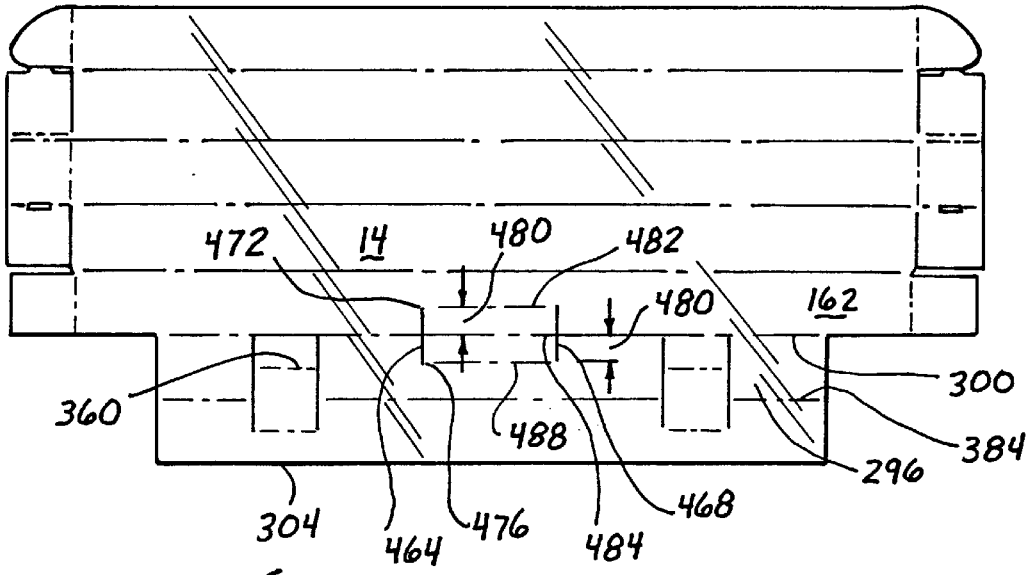
FIG. 6 is a plan view of a second embodiment of the invention providing a compartment for accessories such as golf balls within the container.
Figure 7:
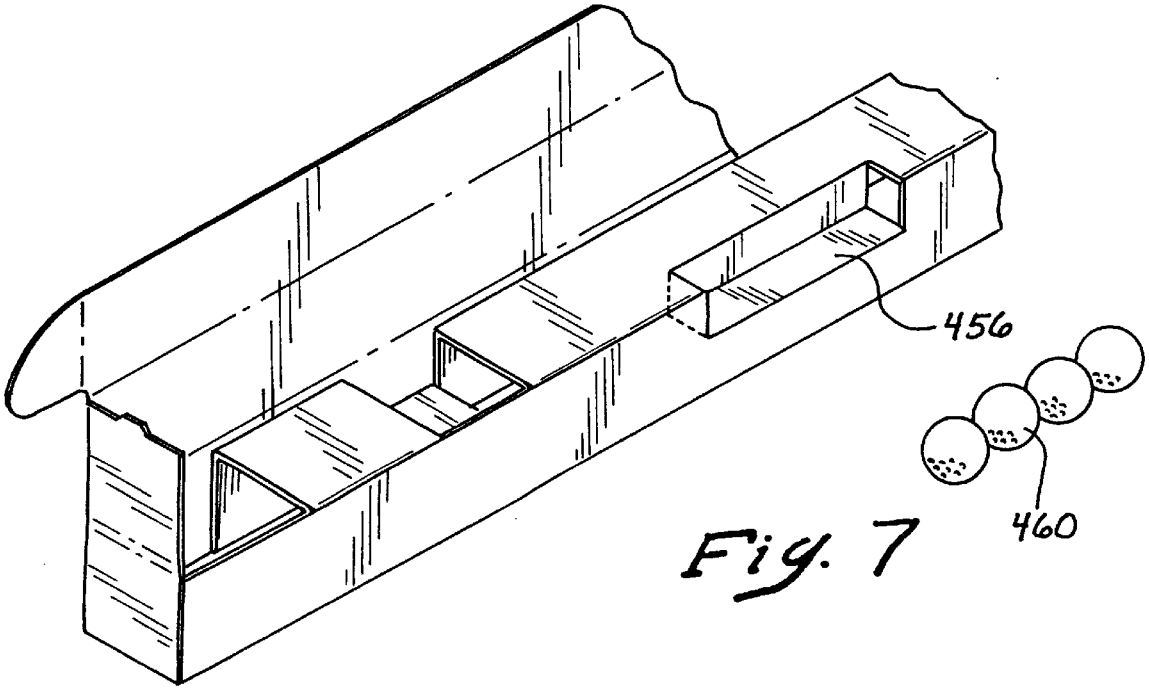
FIG. 7 is a perspective view of one end of the FIG. 6 embodiment illustrating the formation of the compartment within the container.

FIGS. 6 and 7 illustrate another variant of the invention includes a compartment 456 designed to accommodate golf accessories 460 such as a set of golf balls. In this variant eleventh 464 and twelfth 468 cuts are provided. Each of the eleventh 464 and twelfth 468 cuts have a first end 472 and a second end 476 and extend from the first edge 300 of the dividing partition 296 into the dividing partition 296 and into the second side panel 162 for a sixth predetermined distance 480. The eleventh 464 and twelfth 468 cuts are spaced apart by a distance sufficient to accommodate golf accessories 460 such as a set of golf balls.

An eleventh perforation 482 parallel to the first edge 300 of the dividing partition 296 is provided. The eleventh perforation 482 extends from the first end 472 of the eleventh cut 464 to the first end 472 of the twelfth cut 468 at the sixth predetermined distance 480 from the first edge 300 of the dividing partition 296. A twelfth perforation 484 parallel to the first edge 300 of the dividing partition 296 is provided. The twelfth perforation 484 extends from the eleventh cut 464 to the twelfth cut 468 along the first edge 300 of the dividing partition 296. A thirteenth perforation 488 parallel to the first edge 300 of the dividing partition 296 is provided. The thirteenth perforation 488 extends from the second end 476 of the eleventh cut 464 to the second end 476 of the twelfth cut 468 at the sixth predetermined distance 480 from the first edge 300 of the dividing partition 296.

In use, the dividing partition 296 is folded inwardly along the first 360 through seventh 384 and eleventh 482 through thirteenth perforations 488. The partition 296 is then folded inwardly so that its second edge 304 rests on the bottom panel 14. Thus a container divided into a plurality of compartments, including a compartment sized, shaped and located to contain golf accessories 460 such as a set of golf balls, may be formed.

Figure 12:
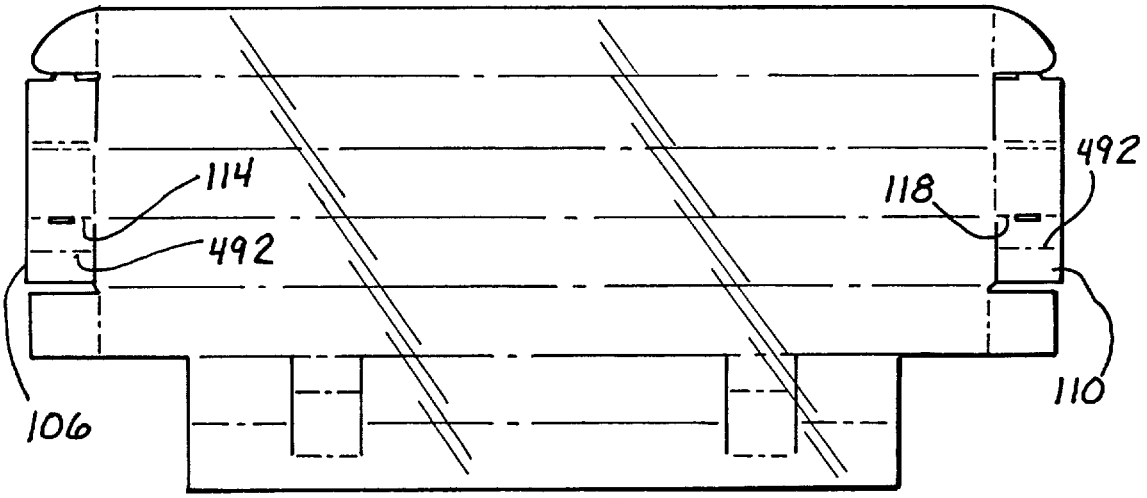
FIG. 12 is a plan view of a fifth embodiment of the invention providing a support platform based on the tab-receiving panels at either end of the container.
Figure 13:
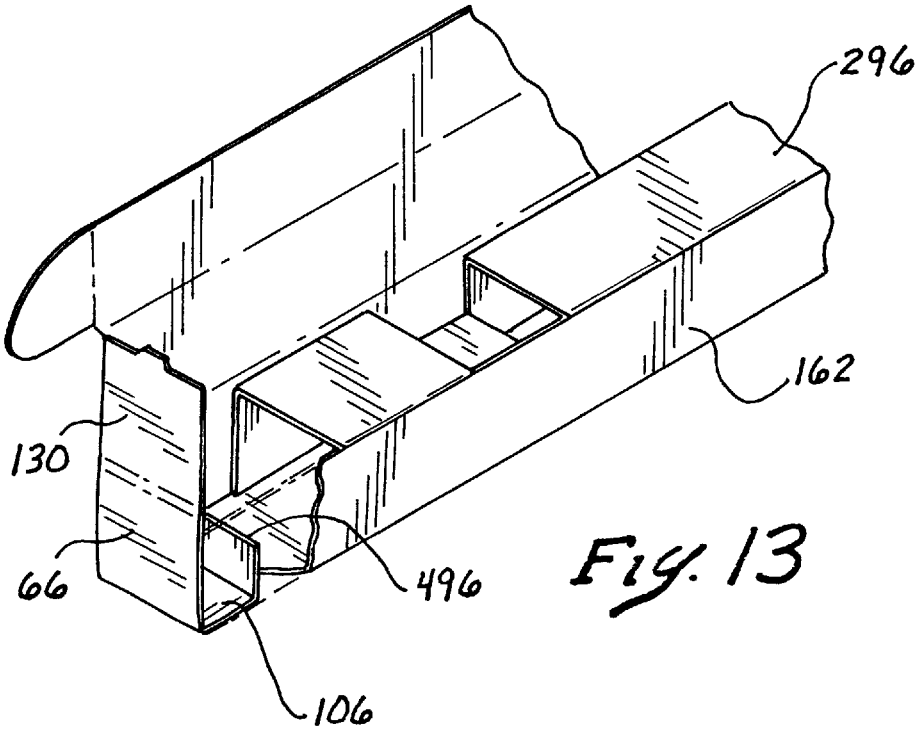
FIG. 13 is a perspective view of one end of the FIG. 12 embodiment illustrating the support platform.

In yet another variant of the invention, illustrated by FIGS. 12 and 13, the first 106 and second 110 tab receiving panels further include a score line 492. The score line 492 is parallel to and spaced from the proximate edge 114, 118 of each of the tab receiving panels 106, 110. When the tab receiving panels 106, 110 are bent upwardly at the score line 492, a support platform 496 will be provided within the container at either end.

Figure 8:
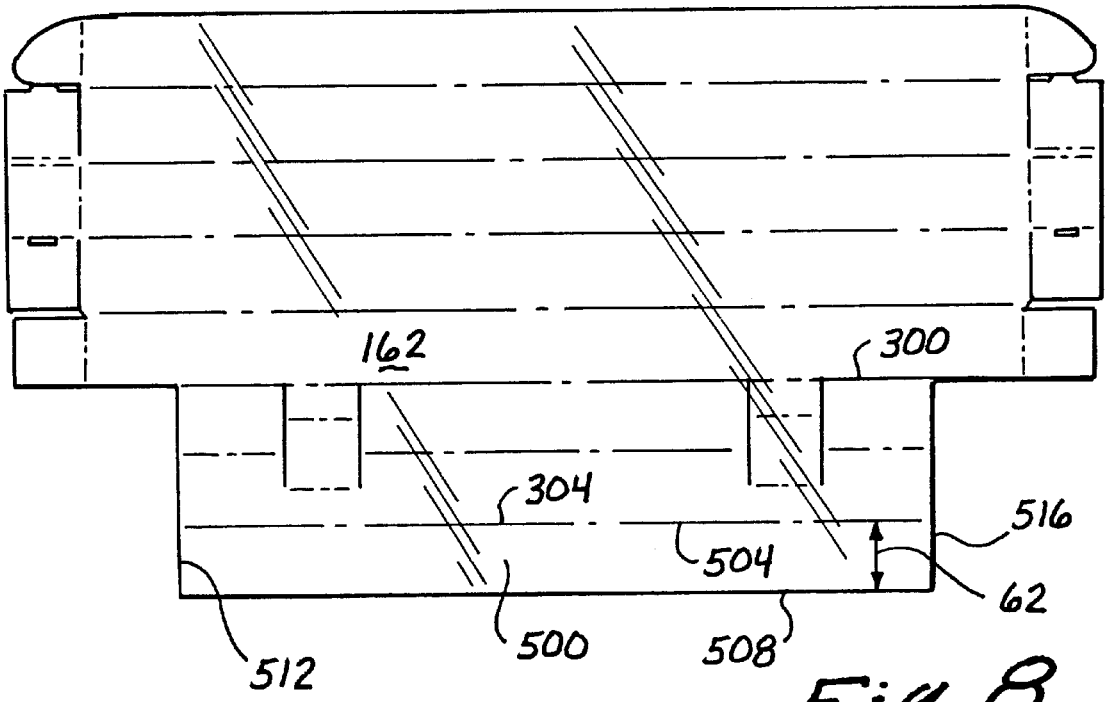
FIG. 8 is a plan view of a third embodiment of the invention providing a strengthening panel positioned parallel to the second side panel within the container.
Figure 9:
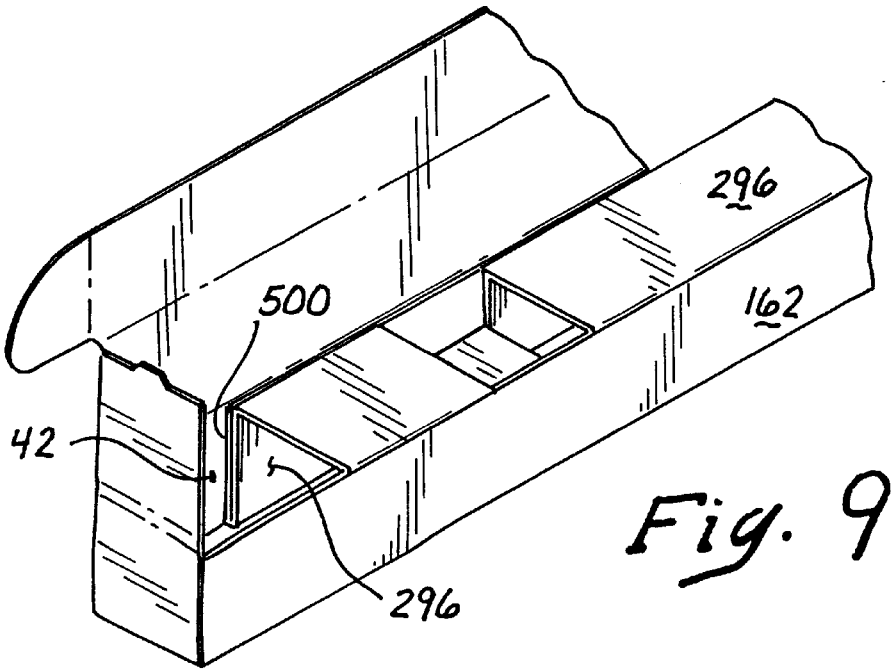
FIG. 9 is a perspective view of one end of the FIG. 8 embodiment illustrating the strengthening panel.

FIGS. 8 and 9 illustrate still another variant, here, a strengthening panel 500 is provided. The strengthening panel 500 has first 504 and second 508 opposed, elongated, parallel edges no longer than the first predetermined length 38 and spaced apart by the first predetermined height 62, and third 512 and fourth 516 opposed end edges. The strengthening panel 500 is foldably joined at its first edge 504 to the second edge 304 of the dividing partition 296.

In use, the strengthening panel 500 is folded outwardly along its first edge 504 and the dividing partition 296 is folded inwardly along its first edge 300 and first 360 through seventh 384 perforations. The dividing partition 296 and the strengthening panel 500 may then be inserted into the open-topped container, thereby proving the container with four vertical panels, including the first 42 and second 162 side panels, the dividing partition 296 and the strengthening panel 500, to resist bending and crushing forces.

Figure 16:
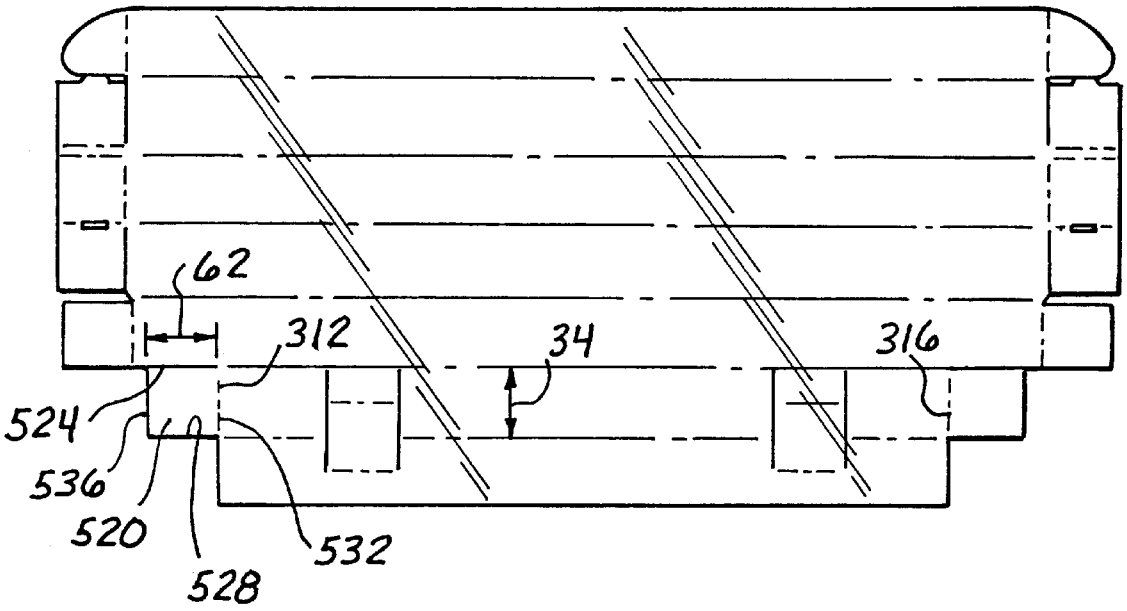
FIG. 16 is a plan view of a seventh embodiment of the invention providing a box shortening panel attached to either end of the dividing partition.
Figure 17:
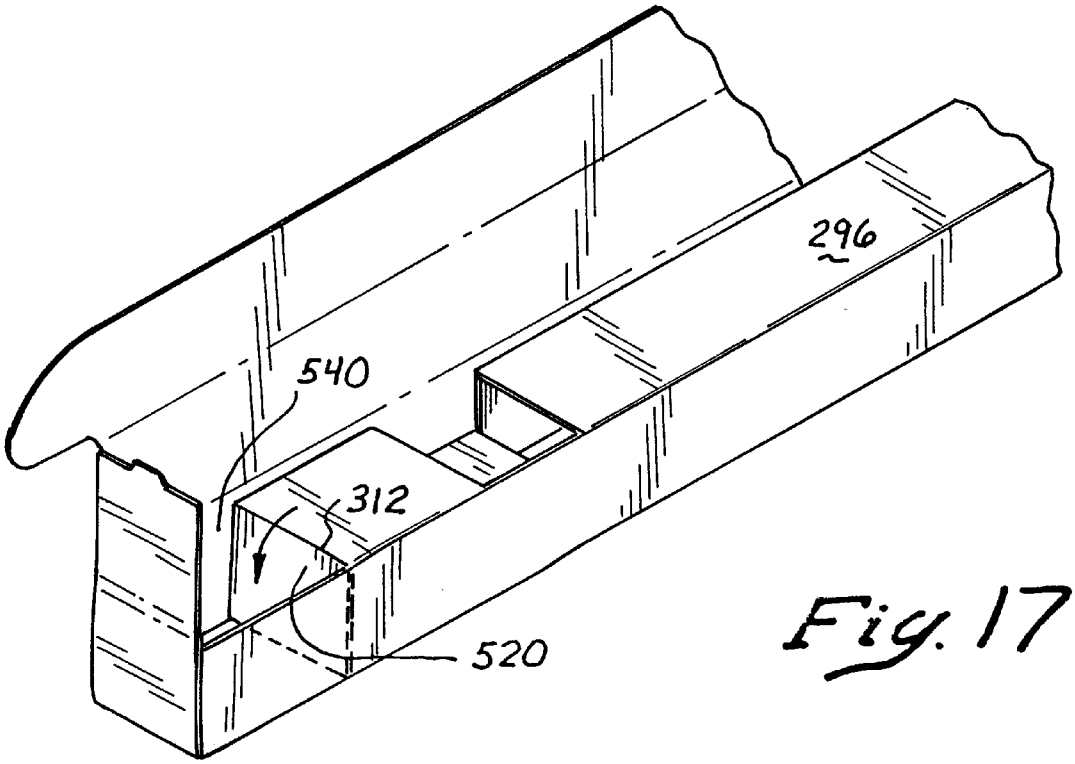
FIG. 17 is a perspective view of one end of the FIG. 16 embodiment illustrating the box shortening panel in place in the container.

In yet a further variant of the invention, illustrated by FIGS. 16 and 17, at least one box-shortening flap 520 is provided. The shortening flap 520 has first 524 and second 528 opposed, parallel edges spaced apart by the first predetermined width 34 and proximate 532 and distal 536 opposed, parallel edges spaced apart by the first predetermined height 62. The flap 520 is foldably joined at its proximate edge 532 to one of the third 312 and fourth 316 edges of the dividing partition 296 adjacent its first edge 300.

When the box shortening flap 520 is folded downwardly from one of the third 312 and fourth 316 edges of the dividing partition 296 and the dividing partition 296 is inserted into the open-topped container, the compartments formed within the container will be shortened and a small, additional compartment 540 will be formed within the container.

Figure 14:
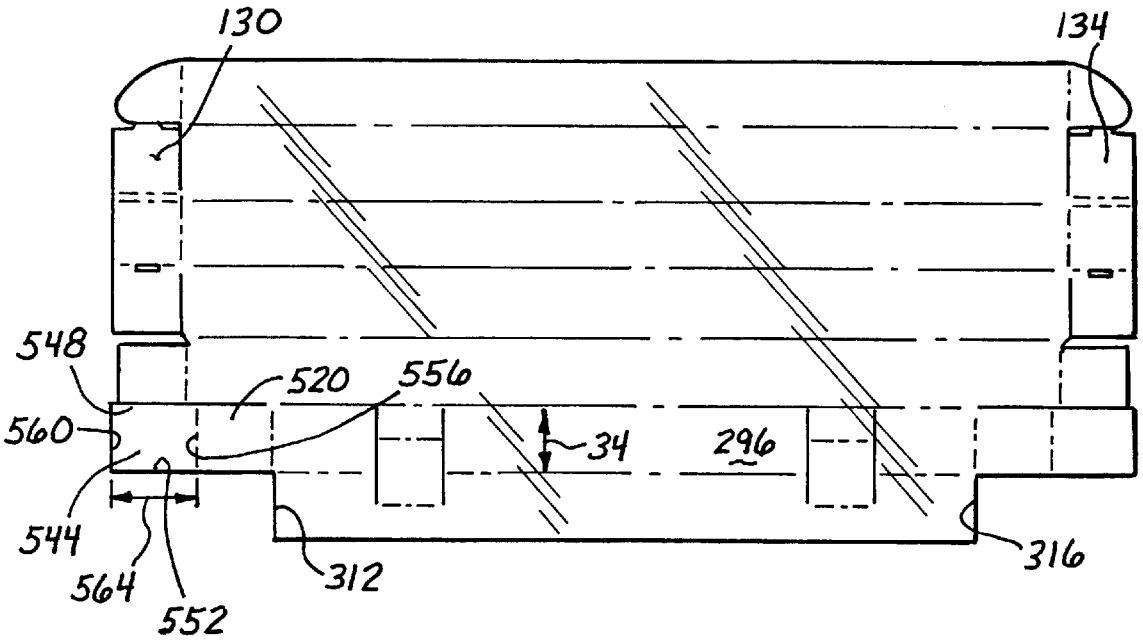
FIG. 14 is a plan view of a sixth embodiment of the invention providing a box shortening panel and a positioning panel attached to either end of the dividing partition.
Figure 15:
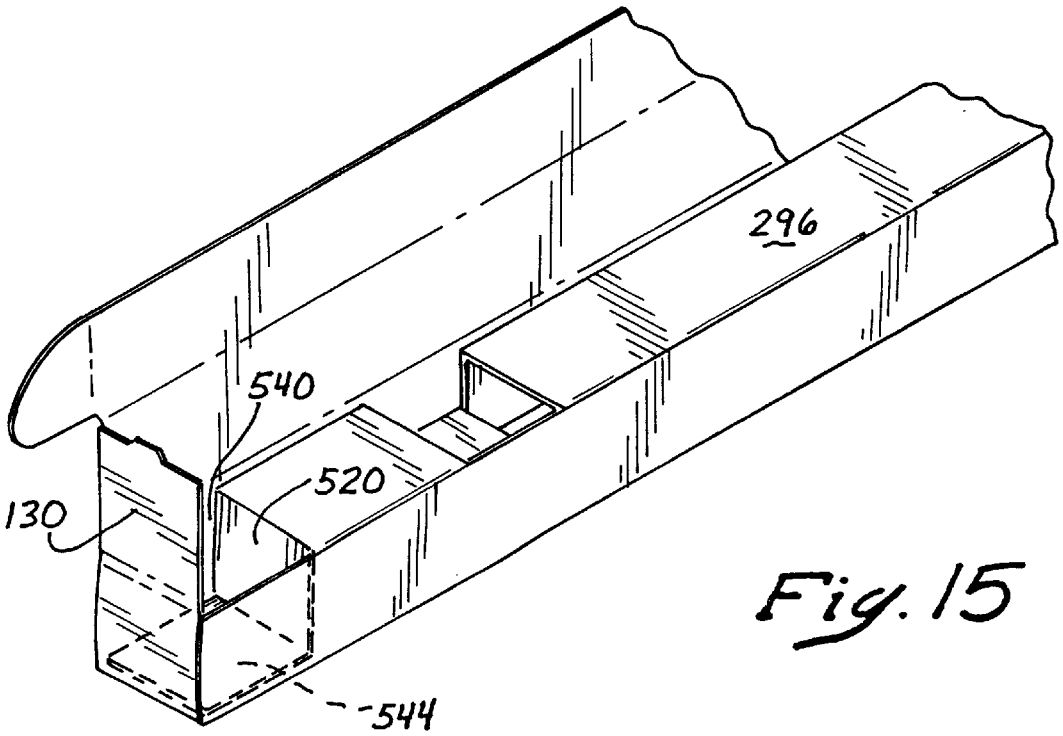
FIG. 15 is a perspective view of one end of the FIG. 14 embodiment illustrating the box shortening panel and the positioning panel in place in the container.

In still a further variant, illustrated by FIGS. 14 and 15, at least one positioning panel 544 is provided. The positioning panel 544 has first 548 and second 552 opposed, parallel edges spaced apart by the first predetermined width 34. It also has proximate 556 and distal 560 opposed, parallel edges spaced apart by the distance 564 from one of the third 312 and fourth 316 edges of the dividing partition 296 to one of the first 130 and second 134 locking panels. The positioning panel 544 is foldably joined at its proximate edge 556 to the distal edge 536 of the shortening flap 520.

In use, the box shortening flap 520 is folded downwardly from one of the third 312 and fourth 316 edges of the dividing partition 296 and the positioning panel 544 is folded upwardly from the shortening flap 520. The dividing partition 296 is then inserted into the open-topped container. The shortening flap 520 will then be fixedly positioned within the container and the compartments formed within the container will be shortened and a small, additional compartment 540 will be formed in the container.

In another variant of the invention, illustrated by FIGS. 18–20, at least one first score line 564 is provided. The first score line 564 is parallel to and spaced from the proximate edge 114, 118 of each of the tab receiving panels 106, 110. A first notch 568 is provided. The first notch 568 extends from the distal edge 112, 116 of the tab receiving panel 106, 110 orthogonally toward the first score line 564.

At least one cell-forming panel 572 is provided. The cell forming panel 572 has first 576 and second 580 opposed, parallel edges spaced apart by the sum of the first predetermined height 62 and one half of the first predetermined width 34. The cell forming panel 572 also has and third 584 and fourth 588 opposed parallel edges spaced apart by the distance between one of the third 312 and fourth 316 edges of the dividing partition 296 and one of the first 130 and second 134 locking panels. The cell-forming panel 572 is foldably joined at its first edge 576 to the second edge 170 of the second side panel 162 and includes a second score line 592. The second score line 592 is spaced from the second edge 170 by one half of the first predetermined width 34. A second notch 596 is provided. The second notch 596 extends from the second edge 580 of the cell-forming panel 572 orthogonally toward the second score line 592.

In use, the open-topped container is assembled and the tab receiving panel 106, 110 is folded upwardly at its score line 564. The cell-forming panel 572 is then folded inwardly from the second edge 170 of the second side panel 162. When this has been done, the second notch 596 of the cell-forming panel 572 will engage the first notch 568 of the tab-receiving panel 106, 110 to form a cell 600 within the container. When the dividing partition 296 is folded inwardly from the second side panel 162 and inserted into the open-topped container, a container having a plurality of compartments will be formed.

In yet another variant of the invention, illustrated by FIGS. 10 and 11, the dividing partition 296 includes at least two pairs of cuts 604, 608, 612, 616. The first cut 604 is spaced from the third edge 312 of the dividing partition 296 and the second cut 608 is spaced from the first cut 604, the third cut 612 is spaced from the forth cut 616 and the forth cut 616 is spaced from the fourth edge 316 of the dividing partition 296. Each of the first 604, second 608, third 612 and fourth 616 cuts extend from the first edge 300 of the dividing partition 296 to a first point 620 spaced from the first edge 300 by the first predetermined distance 344. The cuts then extend from the first point 620 to a second point 624 spaced from the first edge 300 by one half the first predetermined width 34.

A first perforation 628 parallel to the first edge 300 of the dividing partition **296*a* is provided. The first perforation 628 extends from the first point 620 of the first cut 604 to the first point 620 of the second cut 608. A second perforation 632 parallel to the first edge 300 of the dividing partition 296*a* is provided. The second perforation 632 extends from the second point 624 of the first cut 604 to the second point 624 of the second cut 608. A third perforation 636 parallel to the first edge 300 of the dividing partition 296*a* is provided. The third perforation 636 extends from the first point 620 of the first cut 604 to the third edge 312 of the dividing partition 296*a*. A fourth perforation 640 parallel to the first edge 300 of the dividing partition 296*a* is provided. The fourth perforation 640 extends from the first point 620 of the second cut 608 to the first point 620 of the third cut 612**.

A fifth perforation 644 parallel to the first edge 300 of the dividing partition **296*a* is provided. The fifth perforation 644 extends from the first point 620 of the third cut 612 to the first point 620 of the fourth cut 616. A sixth perforation 648 parallel to the first edge 300 of the dividing partition 296*a* is provided. The sixth perforation 648 extends from the second point 624 of the third cut 612 to the second point 624 of the fourth cut 616. A seventh perforation 652 parallel to the first edge 300 of the dividing partition 296*a* is provided, the seventh perforation 652 extends from the first point 620 of the fourth cut 616 to fourth edge 316 of the dividing partition 296*a*. An eighth perforation 656 parallel to the first edge 300 of the dividing partition 296*a* is provided. The eighth perforation 656 extends from the third edge 312 of the dividing partition 296 to the fourth edge 316 of the dividing partition 296*a*. The eighth perforation 656 is spaced from the fourth perforation 640 by the first predetermined height 62**.

In use, the first 106 and second 110 tab receiving panels are folded inwardly from the first 66 and second 70 first side end panels. The first 66 and second 70 first side end panels are next folded inwardly from the first side panel 42, and the first side panel 42 is folded inwardly from the bottom panel 14. The first 182 and second 186 second side end panels are then folded inwardly from the second side panel 162, and the second side panel 162 is folded inwardly from the bottom panel 14.

Next, the first 130 and second 134 locking panels are folded over the first 182 and second 186 second side end panels so that the tab members 154, 158 of the first 130 and second 134 locking panels engage the tab openings 122, 126 of the first 106 and second 110 tab receiving panels. The dividing partition 296*a* is then folded inwardly along the first 628 through seventh 652 perforations and outwardly along the eighth perforation 656. The dividing partition 296*a* is then folded inwardly from the second side panel 162 so that the eighth perforation 656 rests upon the bottom panel 14 and the second edge 304 of the dividing partition 296*a* abuts the first side panel 42. In this manner, an open topped container divided into a plurality of compartments may be formed.

A closed improved reinforced paperboard box for storage and shipping of elongated items 10 may be formed by folding the top panel 222 inwardly from the first side panel and folding the first 280 and second 284 front panel extensions inwardly from the front reinforcing panel 258. Next, the front reinforcing panel 258 is folded inwardly from the top panel 222 and over the second side panel 162, and the first 280 front panel extension is inserted between the first 66 first side end panel and the first 182 second side end panel and the second 284 front panel extension is inserted between the second 70 first side end panel and the second 186 second side end panel.

In a final variation, also illustrated by FIGS. 10 and 11, the first 106 and second 110 tab receiving panels of the previously described variant further include a score line 660. The score line 660 is parallel to and spaced from the proximate edge 114, 118 of each of said tab receiving panels 106, 110. When the tab receiving panels 106, 110 are bent upwardly at the score line 660, a support platform 664 will be provided within the container at either end.

The reinforced paperboard box for storage and shipping of elongated items 10 has been described with reference to particular embodiments. Other modifications and enhancements can be made without departing from the spirit and scope of the claims that follow.

What is claimed is:

1. A reinforced paperboard box for storage and shipping of elongated items, comprising:

a rectangular bottom panel having first and second opposed, elongated, parallel, side edges, third and fourth opposed, parallel end edges normal to the first and second edges, a first predetermined width measured between the first and second edges and a first predetermined length measured between the third and fourth edges;

a first side panel having first and second opposed, elongated, parallel edges of the first predetermined length, third and fourth opposed, parallel end edges, a first predetermined height measured between the first and second edges, said first side panel foldably joined at its second edge to the first edge of the bottom panel;

first and second abutting rectangular first side end panels, each of said first side end panels having first and second opposed, parallel edges of the length of the first predetermined width, and third and fourth opposed, parallel edges of the length of the first predetermined height, said first first side end panel foldably joined at its fourth edge to the third edge of the first side panel and said second first side end panel foldably joined at its third edge to the fourth edge of the first side panel;

first and second tab receiving panels, each of said tab receiving panels having a distal edge and a proximate edge not greater in length than the first predetermined width and being foldably joined at said proximate edge to the second edge of one of the first and second first side end panels;

each of said first and second tab receiving panels including a tab opening disposed along its proximate edge;

first and second locking panels, each of said locking panels having a proximate edge not greater in length than the first predetermined width, an opposed parallel, distal edge and being foldably joined at said proximate edge to the first edge of one of the first and second first side end panels;

each of said first and second locking panels including a tab member extending outwardly from its distal edge, said tab member sized, shaped and disposed to engage the tab opening in one of the first and second tab receiving panels;

a second side panel having first and second opposed, elongated, parallel edges of the first predetermined length, third and fourth opposed, parallel end edges, of the first predetermined height measured between the first and second edges, said second panel foldably joined at its first edge to the second edge of the bottom panel;

first and second abutting rectangular second side end panels, each of said second side end panels having first and second opposed, parallel edges of the length of the first predetermined width, and third and fourth opposed, parallel edges of the length of the first predetermined height, said first second side end panel foldably joined at its fourth edge to the third edge of the second side panel and said second second side end panel foldably joined at its third edge to the fourth edge of the second side panel;

a top panel having first and second opposed, elongated, parallel edges of less than the first predetermined length spaced apart by the first predetermined width and third and fourth opposed, parallel end edges, said top panel foldably joined at its second edge to the first edge of the first side panel;

a front reinforcing panel having first and second opposed, elongated, parallel edges of the first predetermined length spaced apart by no more than the first predetermined height and third and fourth opposed, parallel end edges, said front reinforcing panel foldably joined at its second edge to the first edge of the top panel;

first and second front panel end extensions, each of said end extensions having a proximate edge not greater in length than the first predetermined height and being foldably joined at said proximate edge to one of the third and fourth edges of the front reinforcing panel;

a dividing partition having first and second opposed, elongated, parallel edges of a second predetermined length less than the first predetermined length, spaced apart a second predetermined width equal to the sum of the first predetermined width and the first predetermined height, and third and fourth opposed end edges, said dividing partition foldably joined at its first edge to the second edge of the second side panel;

said dividing partition including at least two pairs of cuts, said first cut spaced from the third edge of the dividing partition and said second cut spaced from said first cut, said third cut spaced from the fourth edge of the dividing partition and said forth cut spaced from said third cut;

each of said first, second, third and fourth cuts extending from the first edge of the dividing partition to a first point spaced from the first edge by a first predetermined distance, from said first point to a second point spaced from the first edge by the first predetermined width, and from said second point to a third point, said third point spaced from the second edge of the dividing partition by a second predetermined distance;

a first perforation parallel to the first edge of the dividing partition, said first perforation extending from the first point of the first cut to the first point of the second cut;

a second perforation parallel to the first edge of the dividing partition, said second perforation extending from the third point of the first cut to the third point of the second cut;

a third perforation parallel to the first edge of the dividing partition, said third perforation extending from the second point of the first cut to the third edge of the dividing partition;

a fourth perforation parallel to the first edge of the dividing partition, said fourth perforation extending from the second point of the second cut to the second point of the third cut;

a fifth perforation parallel to the first edge of the dividing partition, said fifth perforation extending from the first point of the third cut to the first point of the fourth cut;

a sixth perforation parallel to the first edge of the dividing partition, said sixth perforation extending from the third point of the third cut to the third point of the fourth cut;

a seventh perforation parallel to the first edge of the dividing partition, said seventh perforation extending from the second point of the fourth cut to fourth edge of the dividing partition; and whereby, when the first and second tab receiving panels are folded inwardly from the first and second first side end panels, and the first and second first side end panels are folded inwardly from the first side panel, and the first side panel is folded inwardly from the bottom panel, and the first and second second side end panels are folded inwardly from the second side panel, and the second side panel is folded inwardly from the bottom panel, and the first and second locking panels are folded over the first and second second side end panels so that the tab members of said second side end panels engage the tab openings of the first and second tab receiving panels, and the dividing partition is folded inwardly along the first through seventh perforations and inwardly from the second side panel so that its second edge rests upon the bottom panel, an open topped container divided into a plurality of compartments may be formed; and whereby, when the top panel is folded inwardly from the first side panel, and the first and second front panel extensions are folded inwardly from the front reinforcing panel, and the front reinforcing panel is folded inwardly from the top panel and over the second side panel, and the first front panel extension is inserted between the first first side end panel and the first second side end panel, and the second front panel extension is inserted between the second first side end panel and the second second side end panel a closed reinforced paperboard box for storage and shipping of elongated items may be formed.

2. A one-piece, planar, paperboard blank for forming the reinforced paperboard box of claim 1.

3. A reinforced paperboard box for storage and shipping of elongated items as described in claim 1, further comprising a compartment accommodating an accessory such as a videocassette, said compartment comprising:

fifth and sixth cuts, each of said fifth and sixth cuts extending from the first edge of the dividing partition for a third predetermined distance, said fifth and sixth cuts spaced apart by a distance slightly less than the width of a video cassette;

seventh and eighth cuts, said seventh cut extending along the first edge of the dividing partition from the fifth cut toward the third edge of the dividing partition for a fourth predetermined distance, said eighth cut extending along the first edge of the dividing partition from the sixth cut toward the fourth edge of the dividing partition for the fourth predetermined distance;

ninth and tenth cuts, said ninth cut extending orthogonally from the intersection of the seventh cut and the first edge of the dividing partition into the second side panel for a fifth predetermined distance, said distance slightly greater than the thickness of a videocassette, said tenth cut extending orthogonally from the intersection of the eighth cut and the first edge of the dividing partition into the second side panel for the fifth predetermined distance;

an eighth perforation parallel to the first edge of the dividing partition, said eighth perforation extending from the ninth cut to the tenth cut at the fifth predetermined distance from the first edge of the dividing partition;

a ninth perforation parallel to the first edge of the dividing partition, said ninth perforation extending from the fifth cut to the sixth cut at the third predetermined distance from the first edge of the dividing partition;

a tenth perforation parallel to the first edge of the dividing partition, said tenth perforation extending from the fifth cut to the sixth cut at the fifth predetermined distance from the ninth perforation; and whereby when the dividing partition is folded inwardly along the first through tenth perforations and folded inwardly so that its second edge rests on the bottom panel a container divided into a plurality of compartments may be formed, said container having a compartment sized, shaped and disposed to contain a videocassette.

4. A one-piece, planar, paperboard blank for forming the reinforced paperboard box of claim 3.

5. A reinforced paperboard box for storage and shipping of elongated items as described in claim 1, further comprising a compartment accommodating golf accessories such as a set of golf balls, said compartment comprising:

eleventh and twelfth cuts, each of said eleventh and twelfth cuts, having a first end and a second end and extending from the first edge of the dividing partition into the dividing partition and into the second side panel for a sixth predetermined distance, said eleventh and twelfth cuts spaced apart by a distance sufficient to accommodate accommodating golf accessories such as a set of golf balls;

an eleventh perforation parallel to the first edge of the dividing partition, said eleventh perforation extending from the first end of the eleventh cut to the first end of the twelfth cut at the sixth predetermined distance from the first edge of the dividing partition;

an twelfth perforation parallel to the first edge of the dividing partition, said twelfth perforation extending from the eleventh cut to the twelfth cut along the first edge of the dividing partition;

a thirteenth perforation parallel to the first edge of the dividing partition, said thirteenth perforation extending from the second end of the eleventh cut to the second end of the twelfth cut at the sixth predetermined distance from the first edge of the dividing partition;

whereby when the dividing partition is folded inwardly along the first through seventh and eleventh through thirteenth perforations and folded inwardly so that its second edge rests on the bottom panel a container divided into a plurality of compartments may be formed, said container having a compartment sized, shaped and disposed to contain golf accessories such as a set of golf balls.

6. A one-piece, planar, paperboard blank for forming the reinforced paperboard box of claim 5.

7. A reinforced paperboard box for storage and shipping of elongated items as described in claim 1, wherein the first and second tab receiving panels further comprise a score line, said score line being parallel to and spaced from the proximate edge of each of said tab receiving panels, whereby when the tab receiving panels are bent upwardly at the score line, a support platform will be provided within the container at either end.

8. A one-piece, planar, paperboard blank for forming the reinforced paperboard box of claim 7.

9. A reinforced paperboard box for storage and shipping of elongated items as described in claim 1, further comprising:

a strengthening panel, said strengthening panel having first and second opposed, elongated, parallel edges no longer than the first predetermined length and spaced apart by the first predetermined height, third and fourth opposed end edges, said strengthening panel foldably joined at its first edge to the second edge of the dividing partition; and whereby, when the strengthening panel is folded outwardly along its first edge and the dividing partition is folded inwardly along its first edge and first through seventh perforations, the dividing partition and the strengthening panel may be inserted into the open-topped container, thereby proving the container with four vertical panels, including the first and second side panels, the dividing partition and the strengthening panel, to resist bending and crushing forces.

10. A one-piece, planar, paperboard blank for forming the reinforced paperboard box of claim 9.

11. A reinforced paperboard box for storage and shipping of elongated items as described in claim 1, further comprising:

at least one box-shortening flap, said shortening flap having first and second opposed, parallel edges spaced apart by the first predetermined width and proximate and distal opposed, parallel edges spaced apart by the first predetermined height, said flap foldably joined at its proximate edge to one of the third and fourth edges of the dividing partition adjacent its first edge; and whereby, when the box shortening flap is folded downwardly from one of the third and fourth edges of the dividing partition and the dividing partition is inserted into the open-topped container, the compartments formed within the container will be shortened and a small, additional compartment will be formed therewithin.

12. A one-piece, planar, paperboard blank for forming the reinforced paperboard box of claim 11.

13. A reinforced paperboard box for storage and shipping of elongated items as described in claim 11, further comprising:

at least one positioning panel, said positioning panel having first and second opposed, parallel edges spaced apart by the first predetermined width and proximate and distal opposed, parallel edges spaced apart by the distance from one of the third and fourth edges of the dividing partition to one of the first and second locking panels, said positioning panel foldably joined at its proximate edge to the distal edge of the shortening flap; and whereby, when the box shortening flap is folded downwardly from one of the third and fourth edges of the dividing partition and the positioning panel is folded upwardly from the shortening flap and the dividing partition is inserted into the open-topped container, the shortening flap will be fixedly positioned within the container and the compartments formed within the container will be shortened and a small, additional compartment will be formed therewithin.

14. A one-piece, planar, paperboard blank for forming the reinforced paperboard box of claim 13.

15. A reinforced paperboard box for storage and shipping of elongated items as described in claim 1, further comprising:

at least one first score line, said score line being parallel to and spaced from the proximate edge of each of said tab receiving panels;

a first notch, said first notch extending from the distal edge of the tab receiving panel orthogonally toward the first score line;

at least one cell-forming panel, said cell forming panel having first and second opposed, parallel edges spaced apart by the sum of the first predetermined height and one half of the first predetermined width, and third and fourth opposed parallel edges spaced apart by the distance between one of the third and fourth edges of the dividing partition and one of the first and second locking panels, said cell-forming panel foldably joined at its first edge to the second edge of the second side panel and including a second score line, said second score line spaced from said second edge by one half of the first predetermined width;

a second notch, said second notch extending from the second edge of the cell-forming panel orthogonally toward the second score line; and whereby, when the open-topped container is assembled and the tab receiving panel is folded upwardly at its score line and the cell-forming panel is folded inwardly from the second edge of the second side panel, the second notch of the cell-forming panel will engage the first notch of the tab receiving panel to form a cell within the container, and when the dividing partition is folded inwardly from the second side panel and inserted into the open-topped container, a container having a plurality of compartments will be formed.

16. A one-piece, planar, paperboard blank for forming the reinforced paperboard box of claim 15.

17. A reinforced paperboard box for storage and shipping of elongated items, comprising:

a rectangular bottom panel having first and second opposed, elongated, parallel, side edges, third and fourth opposed, parallel end edges normal to the first and second edges, a first predetermined width measured between the first and second edges and a first predetermined length measured between the third and fourth edges;

a first side panel having first and second opposed, elongated, parallel edges of the first predetermined length, third and fourth opposed, parallel end edges, a first predetermined height measured between the first and second edges, said first side panel foldably joined at its second edge to the first edge of the bottom panel;

first and second abutting rectangular first side end panels, each of said first side end panels having first and second opposed, parallel edges of the length of the first predetermined width, and third and fourth opposed, parallel edges of the length of the first predetermined height, said first first side end panel foldably joined at its fourth edge to the third edge of the first side panel and said second first side end panel foldably joined at its third edge to the fourth edge of the first side panel;

first and second tab receiving panels, each of said tab receiving panels having a distal edge and a proximate edge not greater in length than the first predetermined width and being foldably joined at said proximate edge to the second edge of one of the first and second first side end panels;

each of said first and second tab receiving panels including a tab opening disposed along its proximate edge;

first and second locking panels, each of said locking panels having a proximate edge not greater in length than the first predetermined width, an opposed parallel, distal edge and being foldably joined at said proximate edge to the first edge of one of the first and second first side end panels;

each of said first and second locking panels including a tab member extending outwardly from its distal edge, said tab member sized, shaped and disposed to engage the tab opening in one of the first and second tab receiving panels;

a second side panel having first and second opposed, elongated, parallel edges of the first predetermined length, third and fourth opposed, parallel end edges, of the first predetermined height measured between the first and second edges, said second panel foldably joined at its first edge to the second edge of the bottom panel;

first and second abutting rectangular second side end panels, each of said second side end panels having first and second opposed, parallel edges of the length of the first predetermined width and third and fourth opposed, parallel edges of the length of the first predetermined height, said first second side end panel foldably joined at its fourth edge to the third edge of the second side panel and said second second side end panel foldably joined at its third edge to the fourth edge of the second side panel;

a top panel having first and second opposed, elongated, parallel edges of less than the first predetermined length spaced apart by the first predetermined width and third and fourth opposed, parallel end edges, said top panel foldably joined at its second edge to the first edge of the first side panel;

a front reinforcing panel having first and second opposed, elongated, parallel edges of the first predetermined length spaced apart by no more than the first predetermined height and third and fourth opposed, parallel end edges, said front reinforcing panel foldably joined at its second edge to the first edge of the top panel;

first and second front panel end extensions, each of said end extensions having a proximate edge not greater in length than the first predetermined height and being foldably joined at said proximate edge to one of the third and fourth edges of the front reinforcing panel;

a dividing partition having first and second opposed, elongated, parallel edges of a second predetermined length less than the first predetermined length, spaced apart a second predetermined width equal to the sum of the first predetermined width and the first predetermined height, and third and fourth opposed end edges, said dividing partition foldably joined at its first edge to the second edge of the second side panel;

said dividing partition including at least two pairs of cuts, said first cut spaced from the third edge of the dividing partition and said second cut spaced from said first cut, said third cut spaced the fourth cut and said forth cut spaced from the fourth edge of the dividing partition;

each of said first, second, third and fourth cuts extending from the first edge of the dividing partition to a first point spaced from the first edge by the first predetermined distance, from said first point to a second point spaced from the first edge by one half the first predetermined width;

a first perforation parallel to the first edge of the dividing partition, said first perforation extending from the first point of the first cut to the first point of the second cut;

a second perforation parallel to the first edge of the dividing partition, said second perforation extending from the second point of the first cut to the second point of the second cut;

a third perforation parallel to the first edge of the dividing partition, said third perforation extending from the first point of the first cut to the third edge of the dividing partition;

a fourth perforation parallel to the first edge of the dividing partition, said fourth perforation extending from the first point of the second cut to the first point of the third cut;

a fifth perforation parallel to the first edge of the dividing partition, said fifth perforation extending from the first point of the third cut to the first point of the fourth cut;

a sixth perforation parallel to the first edge of the dividing partition, said sixth perforation extending from the second point of the third cut to the second point of the fourth cut;

a seventh perforation parallel to the first edge of the dividing partition, said seventh perforation extending from the first point of the fourth cut to fourth edge of the dividing partition;

an eighth perforation parallel to the first edge of the dividing partition, said eighth perforation extending from the third edge of the dividing partition to the fourth edge of the dividing partition, said eighth perforation spaced from the fourth perforation by the first predetermined height; and whereby, when the first and second tab receiving panels are folded inwardly from the first and second first side end panels, and the first and second first side end panels are folded inwardly from the first side panel, and the first side panel is folded inwardly from the bottom panel, and the first and second second side end panels are folded inwardly from the second side panel, and the second side panel is folded inwardly from the bottom panel, and the first and second locking panels are folded over the first and second second side end panels so that the tab members of said second side end panels engage the tab openings of the first and second tab receiving panels, and the dividing partition is folded inwardly along the first through seventh perforations and outwardly along the eighth perforation and inwardly from the second side panel so that the eighth perforation rests upon the bottom panel and the second edge of the dividing partition abuts the first side panel, an open topped container divided into a plurality of compartments may be formed; and whereby, when the top panel is folded inwardly from the first side, and the first and second front panel extensions are folded inwardly from the front reinforcing panel, and the front reinforcing panel is folded inwardly from the top panel and over the second side panel, and the first front panel extension is inserted between the first first side end panels and the first second side end panel, and the second front panel extension is inserted between the second first side end panels and the second second side end panel a closed reinforced paperboard box for storage and shipping of elongated items may be formed.

18. A one-piece, planar, paperboard blank for forming the reinforced paperboard box of claim 17.

19. A reinforced paperboard box for storage and shipping of elongated items as described in claim 17, wherein the first and second tab receiving panels further comprise a score line, said score line being parallel to and spaced from the proximate edge of each of said tab receiving panels, whereby when the tab receiving panels are bent upwardly at the score line, a support platform will be provided within the container at either end.

20. A one-piece, planar, paperboard blank for forming the reinforced paperboard box of claim 19.

* * * * *